US009121105B2

(12) United States Patent
Kadowaki et al.

(10) Patent No.: US 9,121,105 B2
(45) Date of Patent: Sep. 1, 2015

(54) PROCESS FOR PRODUCING ENVIRONMENTALLY-FRIENDLY STEEL SHEET FOR CONTAINER MATERIAL, ENVIRONMENTALLY-FRIENDLY STEEL SHEET FOR CONTAINER MATERIAL, AND LAMINATED AND PRE-COATED STEEL SHEET FOR CONTAINER MATERIAL USING THE SAME

(75) Inventors: Nobuo Kadowaki, Tokyo (JP); Hironori Nakayama, Tokyo (JP); Yuji Abe, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 251 days.

(21) Appl. No.: 13/639,322

(22) PCT Filed: Apr. 6, 2011

(86) PCT No.: PCT/JP2011/059121

§ 371 (c)(1),
(2), (4) Date: Oct. 4, 2012

(87) PCT Pub. No.: WO2011/126137

PCT Pub. Date: Oct. 13, 2011

(65) Prior Publication Data

US 2013/0029176 A1 Jan. 31, 2013

(30) Foreign Application Priority Data

Apr. 6, 2010 (JP) ..... 2010-087909

(51) Int. Cl.

| | |
|---|---|
| ***C25D 5/36*** | (2006.01) |
| ***C25D 5/34*** | (2006.01) |
| ***C25D 9/08*** | (2006.01) |
| ***C25D 3/54*** | (2006.01) |
| ***C25F 1/02*** | (2006.01) |

(52) U.S. Cl.
CPC .. *C25D 9/08* (2013.01); *C25D 3/54* (2013.01); *C25D 5/36* (2013.01); *C25F 1/02* (2013.01); *Y10T 428/12611* (2015.01)

(58) Field of Classification Search
CPC ..... C25D 5/36; C25D 7/00; C25D 11/00
USPC ..... 205/217, 219
See application file for complete search history.

(56) References Cited

U.S. PATENT DOCUMENTS 5,259,960 A * 11/1993 Beck et al. ..... 210/638
2010/0203355 A1 8/2010 Kadowaki et al.

FOREIGN PATENT DOCUMENTS

JP 59006393 A * 1/1984 ..... C25D 5/10
JP 2004307923 A * 11/2004 ..... C23C 28/00
JP 2005325402 A * 11/2005 ..... C25D 11/38

(Continued)

OTHER PUBLICATIONS

International Search Report, dated Jun. 14, 2011, issued in PCT/JP2011/059121.

*Primary Examiner* — Edna Wong
(74) *Attorney, Agent, or Firm* — Birch, Stewart, Kolasch & Birch, LLP

(57) ABSTRACT

A method for the cathodic electrocoating of a tin-coated steel sheet in a treatment solution that does not contain any Cr compound, F or nitrite nitrogen. A tin oxide layer that is not subjected to a cathodic electrocoating treatment yet and is arranged on a tin-coated steel sheet is thinned to a specified thickness or less by a cathodic electrocoating treatment in an aqueous solution containing sodium carbonate or sodium hydrogen carbonate or an aqueous sulfuric acid solution immersion treatment, and the tin oxide layer is subjected to a cathodic electrocoating treatment in an aqueous solution of an alkaline metal sulfate containing a zirconium compound having a specified composition. In this manner, a coating film is formed on the tin oxide layer at a specific adhered amount in terms of Zr content.

8 Claims, 13 Drawing Sheets

(56) References Cited

FOREIGN PATENT DOCUMENTS

| | | | | | |
|---|---|---|---|---|---|
| JP | 2008-184630 A | | 8/2008 | | |
| JP | 2008184630 A | * | 8/2008 | ..... | C25D 9/08 |
| JP | 2009-68108 A | | 4/2009 | | |
| JP | 2009-249691 A | | 10/2009 | | |

* cited by examiner

PROCESS FOR PRODUCING ENVIRONMENTALLY-FRIENDLY STEEL SHEET FOR CONTAINER MATERIAL, ENVIRONMENTALLY-FRIENDLY STEEL SHEET FOR CONTAINER MATERIAL, AND LAMINATED AND PRE-COATED STEEL SHEET FOR CONTAINER MATERIAL USING THE SAME

TECHNICAL FIELD

The present invention relates to a surface-treated metal material and a method of surface-treating the metal material. More specifically, the present invention relates to an environmentally-friendly steel sheet for a container, wherein a steel sheet can be primer-treated without using a treatment solution containing chrome, fluorine, or nitrate nitrogen, and a process for producing the same.

BACKGROUND ART

As the treatment for improving the adhesion between an organic film and a metal material such as steel sheet, zinc-based plated steel sheet, zinc-alloy sheet, tin-based plated steel sheet and aluminum alloy sheet, there have heretofore been known chromate treatment, phosphate treatment, silane coupling treatment, etc. Among these, the chromate treatment has been broadly utilized in the fields of home electrical appliances, building materials, vehicles, metal containers, etc., due to its superior corrosion resistance and adhesion. However, there has been pointed out the possibility of the toxic substance of hexavalent chrome contaminating the soil, etc., by the leaching thereof into the soil at the time of the disposal of the chromate-treated products. Accordingly, the industries mainly in Europe, are ready to eliminate the chromate treatment at the present stage.

In the field of metal materials to be used for containers, a certain type of chromate treatment method is being utilized, such that a tin-plated steel sheet is treated by cathodic electrolysis in an aqueous solution of sodium bichromate, or a steel sheet is treated by cathodic electrolysis in an aqueous solution of fluorine-containing anhydrous chromic acid, so as not to leave hexavalent chrome in the resultant film. However, even in the case of the chromate treatment of a type where the treated layer does not include hexavalent chrome, the treatment solution to be used therefor contains the hexavalent chrome, and accordingly, the hexavalent chrome has to be rendered harmless for the treatment or disposal of the waste-water and gas emissions. For this reason, from the viewpoint of the environmental load, a surface treatment is desirable such that the treatment solution does not include hexavalent chrome either.

From this viewpoint, in order to make a treatment solution hexavalent chromium-free, attempts to eliminate chromium have come to attract attention, and such chromium-free attempts include investigation on the removal of chromium from a coating film or plating per se, a coating film or alternative plating which is alternative to chromium or chromium plating.

Further, with respect to fluorine, boron, nitrate nitrogen, etc., are also not preferable from the viewpoint of the environmental load. In the future, the industries will be encountered with toughened emission standards therefor. Therefore, the treatment solutions for metal materials to be used for containers may preferably be those which do not contain the substances as described above.

Therefore, as one measure for reducing the environmental load, there is elimination of the use of chrome. Patent Document 1 discloses an example of the method of surface-treating a tin-plated steel can superior in corrosion resistance and coating adhesion, wherein a container material is chrome-free surface-treated by providing, on a tin-plated surface of a tin-plated steel sheet, an organic-inorganic composite coating comprising an organic compound main comprising carbon and an inorganic phosphorus compound. Patent Document 2 discloses, as a surface treatment solution for an aluminum can or tin-plated DI (drawing and ironing) can prior to the coating and printing thereof, an example of the surface treatment solution for DI can, which contains at least one kind of phosphoric acid ions and a zirconium compound and titanium compound, and contains an oxidizing agent and at least one kind of fluoric acid and a fluoride.

Conventionally, the metal containers to be used for beverage can and food can applications have generally been treated so as to bake the coatings at the inside and outside surfaces of the cans, after the manufacturing of the cans. In recent years, as the metal materials to be used for beverage cans or food cans, there have been increasingly used a steel sheet with a film which has been hot-laminated on the steel sheet in advance, and a pre-coated steel sheet comprising a steel sheet which has been subjected to a coating treatment including printing and baking, in advance.

However, in the can manufacturing using DI or DRD (drawing and redrawing), an ironing force acts on the can wall, so in a case where a can is manufactured by using a laminated steel sheet or coating pre-coated steel sheet type of metal material for container, if the adhesive strength between the resin coating and the steel sheet is not sufficient, there is caused a problem such that the resin coating will easily be peeled off. Further, in the sterilization (i.e., retort treatment) which is to be performed after filling of the can with a content, water in the content sometimes permeates the resin coating under the high temperature and high pressure conditions, and the adhesion is liable to be decreased. Accordingly, even in the development of the chromium-free type steel sheet for container material, it is necessary to attain an excellent adhesion between the resin coating and the steel sheet.

With respect to such a requirement for the container materials, as disclosed in Patent Document 3, the present inventors have developed a chromium-free steel sheet for a container material having an excellent adhesion in which a zirconium compound-containing coating film is formed on a tin-plated steel sheet, and have developed a steel sheet for container material having an adhesion which is equal to or greater than that of the conventional chromate treatment. However, the invention disclosed in Patent Document 3 had a drawback such that, in the electrolytic treatment therefor, it is necessary to finely regulate the electrolytic conditions during the treatment in order to maintain the coating amount in an appropriate range.

PRIOR ART DOCUMENTS

Patent Documents

[Patent Document 1] JP-A (Japanese Unexamined Patent Publication; Kokai) No. 11-264075

[Patent Document 2] JP-A No. 7-48677

[Patent Document 3] JP-A No. 2009-68108

SUMMARY OF THE INVENTION

Problem to be Solved by the Invention

An object of the present invention is to provide a chromium-free steel sheet for a container material having excellent characteristics (for example, adhesion with an organic resin coating such as laminate film or coating material; and resistance to iron dissolution after dent impact), which are equal or comparable to those of the conventional steel sheets for container material which have been subjected to chromium plating or chromate coating treatment.

Another object of the present invention is to provide a process for producing a chromium-free steel sheet for a container material having excellent characteristics as mentioned above, which also enables easy and stable production of the chromium-free steel sheet.

Means for Solving the Problem

As a result of earnest study on chromium-free processes which do not use chromium in the plating or in the coating film to be disposed thereon for the purpose of solving the above problem, the present inventors have found a process which is environmentally friendly, and can easily and stably produce a chromium-free steel sheet for a container material having an excellent adhesion, as describe hereinbelow.

More specifically, the present invention relates to a process for producing an environmentally friendly steel sheet for a container material, comprising a step of subjecting a tin-plated steel sheet to a cathodic electrolytic coating treatment in a treatment solution not containing a chromium compound, fluorine, or a nitrate nitrogen, wherein:

a tin oxide layer present on a tin-plated steel sheet before the cathodic electrolytic coating treatment is removed by a cathodic electrolytic treatment in an aqueous solution containing sodium carbonate or sodium hydrogen carbonate, or by an immersion treatment in an aqueous sulfuric acid solution, so as to provide a thickness of 0 $mC/cm^2$ or more and 3.5 $mC/cm^2$ or less as measured by electrolytic stripping method, and then;

a coating film having a film coating amount converted to zirconium of 0.1 $mg/m^2$ or more and 20 $mg/m^2$ or less is formed by a cathodic electrolytic coating treatment in an aqueous solution of an alkali metal sulfate containing a zirconium compound with an electric conductivity of 0.2 S/m or more and 6.0 S/m or less and a pH of 1.5 or more and 2.5 or less.

The present invention also provides an environmentally friendly steel sheet for a container material, comprising a tin-plated steel sheet and a zirconium compound-containing coating film disposed thereon, wherein a tin oxide layer present on the tin-plated steel sheet is 0 $mC/cm^2$ or more and 3.5 $mC/cm^2$ or less, and the zirconium compound-containing coating film has a film coating amount converted to zirconium of 0.1 $mg/m^2$ or more and 20 $mg/m^2$ or less.

According to the discovery and investigation of the present inventors, it is presumed that, in the invention disclosed in Patent Document 3, the electrolytic condition in the electrolytic treatment in this document is required to be finely regulated so as to maintain the coating amount in an appropriate range, because the coating amount of the coating film tends to be increased abruptly, with respect to an increase in the current density (see FIG. 2 and FIG. 3 appearing hereinafter). it is also presumed that such a change in the coating amount of the coating film is caused by a pH change (i.e., an increase in the pH) due to the hydrogen gas release in the vicinity of the electrode for electrolysis, to thereby cause a change in the coating amount of the coating film (i.e., an increase in the coating amount of the coating film). In addition, it is presumed that the progress of the film coating process (i.e., consumption of zirconium) per se causes an increase in the pH, and this pH increase accelerates the above pH change.

As a result of such phenomena, in the prior art, it presumed to be indispensable, to finely regulate the electrolytic conditions in response to the variation in the process conditions (such as sheet width, line speed, and liquid temperature) so as to maintain the coating amount in an appropriate range, by suitably controlling the above tendency to cause the "abrupt increase in the coating amount of coating film."

In contrast thereto, the present inventors have found that a large amount of alkali metal ions such as $Na^+$ and $K^+$ in the electrolytic solution neutralize $OH^-$ ions in the vicinity of the cathode, so as to provide a tendency of relieving (or reducing) the local pH variation in the vicinity of the cathode, and on the basis of the tendency, the zirconium oxide ions ($ZrO^{2+}$) are stabilized. Based on such a discovery, the present inventors have completed the present invention.

According to the present invention, a curve showing "changes in the film coating amount converted to zirconium" corresponding to the pH change in the vicinity of the electrode for electrolysis can be smoothened (as shown in the graphs of FIG. 2 and FIG. 3 appearing hereinafter). Therefore, it is presumed that, according to the present invention, "the film coating amount converted to zirconium" can stably be controlled, so as to enable the stable film deposition treatment.

In other words, the present invention has a characteristic such that $ZrO^{2+}$ to be deposited on a plated surface is added (actually, zirconium sulfate is added) by using an easily electrolyzable "aqueous solution of an alkali metal sulfate" as a main component.

The present invention may include the following embodiments.

[1] A process for producing an environmentally friendly steel sheet for a container material, comprising a step of subjecting a tin-plated steel sheet to a cathodic electrolytic coating treatment in a treatment solution not containing a chromium compound, fluorine, or a nitrate nitrogen, wherein:

a tin oxide layer present on a tin-plated steel sheet before the cathodic electrolytic coating treatment is removed by a cathodic electrolytic treatment in an aqueous solution containing sodium carbonate or sodium hydrogen carbonate, or by an immersion treatment in an aqueous sulfuric acid solution, so as to provide a thickness of 0 $mC/cm^2$ or more and 3.5 $mC/cm^2$ or less as measured by electrolytic stripping method, and then;

a coating film having a film coating amount converted to zirconium of 0.1 $mg/m^2$ or more and 20 $mg/m^2$ or less is formed by a cathodic electrolytic coating treatment in an aqueous solution of an alkali metal sulfate containing a zirconium compound with an electric conductivity of 0.2 S/m or more and 6.0 S/m or less and a pH of 1.5 or more and 2.5 or less.

[2] The process for producing an environmentally friendly steel sheet for a container material according to [1], wherein the concentration of zirconium contained in the aqueous solution of an alkali metal sulfate is 10 mg/L or more and 2000 mg/L or less.

[3] The process for producing an environmentally friendly steel sheet for a container material according to [1] or [2], wherein the alkali metal sulfate is sodium sulfate.

[4] The process for producing an environmentally friendly steel sheet for a container material according to [1] or [2], wherein the alkali metal sulfate is potassium sulfate.

[5] The process for producing an environmentally friendly steel sheet for a container material according to [1] or [2], wherein the concentration of the alkali metal sulfate contained in the aqueous solution of the alkali metal sulfate is 0.1 mass % or more and 8.0 mass % or less.

[6] An environmentally friendly steel sheet for a container material, comprising a tin-plated steel sheet and a zirconium compound-containing coating film disposed thereon, wherein a tin oxide layer present on the tin-plated steel sheet is 0 $mC/cm^2$ or more and 3.5 $mC/cm^2$ or less, and the zirconium compound-containing coating film has a film coating amount converted to zirconium of 0.1 $mg/m^2$ or more and 20 $mg/m^2$ or less.

[7] An environmentally friendly laminated steel sheet for a container material, comprising the steel sheet for a container material according to [6].

[8] An environmentally friendly precoated steel sheet for a container material, comprising the steel sheet for a container material according to [6].

Effect of the Invention

The steel sheet for a container material having a light environmental load which has been produced by the production process according to the present invention has an adhesion with an organic resin coating film such as a laminated film or a coating material, and also has an excellent performance as a chromium-free steel sheet for a container material such as resistance to iron dissolution after dent impact, which is equal or comparable to that of the conventional chromium-treated steel sheet for a container material. In addition, such a steel sheet for a container material can be produced easily and stably, and therefore the industrial value thereof is very high.

MODES FOR CARRYING OUT THE INVENTION

Figure 1:
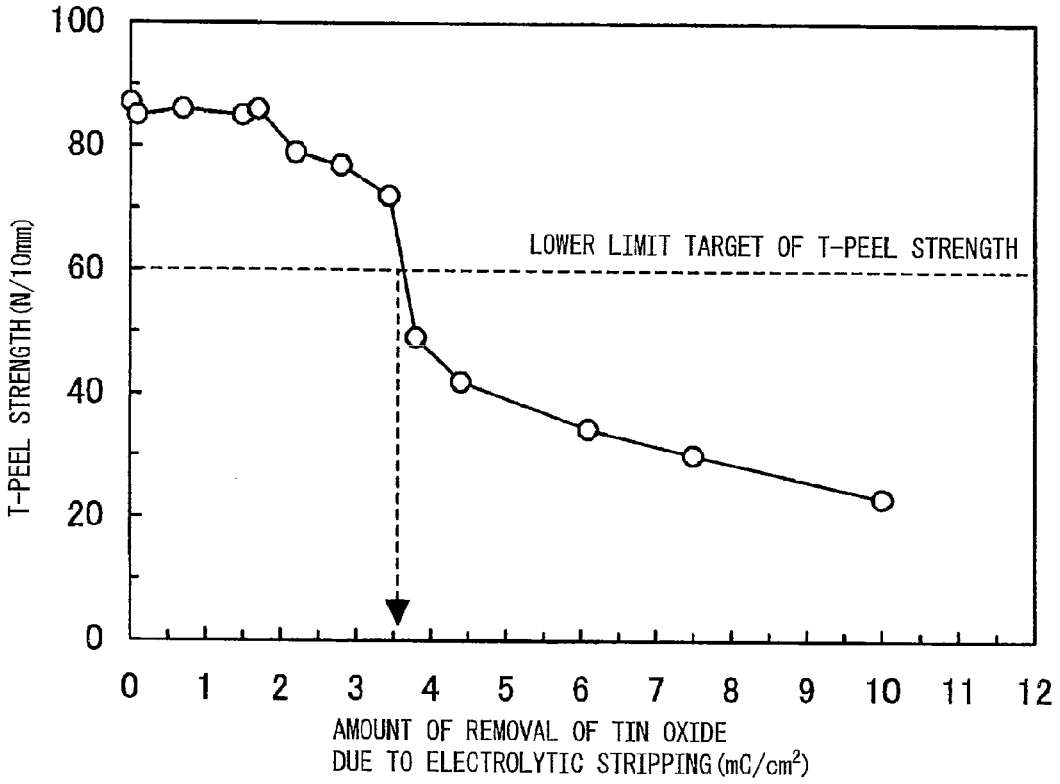
FIG. 1 is a graph showing a relationship between the amount (amount of removal due to electrolytic stripping) of tin oxide on a tin-plated surface, and coating material adhesion (T-peel strength) of a tin-plated steel sheet which has been coated with a film of zirconium compound.

The present invention relates to a process for producing a steel sheet for a container material, wherein a tin-plated steel sheet is subjected to a cathodic electrolytic coating treatment in a treatment solution which does not contain a chromium compound, fluorine, or nitrate nitrogen. The steel sheet for a container material having a small environmental load which has been obtained by the present invention is a steel sheet wherein a cathodic electrolytic coating treatment layer comprising a zirconium compound has been formed on the surface of a tin-plated steel sheet.

The present invention specifically relates to a process for producing a steel sheet for a container material having a small environmental load, wherein a cathodic electrolytic coating treatment film can be obtained by cathodic electrolytic coating treatment in an aqueous alkali metal sulfate solution comprising a zirconium compound which does not contain a chromium compound, fluorine or nitrate nitrogen.

The best mode for carrying out the invention will be explained below.

<Steel Sheet>

The type of the steel sheet to be used in the present invention is not particularly limited. It is possible to use a steel sheet which is the same as the steel sheet which has been used for materials for containers.

<Tin Plating>

The type of the steel sheet to be used in the cathodic electrolytic coating treatment according to the present invention is not particularly limited. However, a tin-plated steel sheet may be most suitable as the environmentally friendly steel sheet for a container material according to the present invention, in view of the reasons such as good record of use in canning applications, freedom from problems in food safety and sanitation, superiority in corrosion resistance, superiority in formability, and comparatively low cost as compared with that of other plating.

The tin-plated steel sheet to be used in the present invention may be a conventional electroplated tin plate, and may be treated by iron-tin alloying (reflow treatment) after the tin plating, as desired. The amount of tin plating may preferably be in the range of 0.5 to 12.0 g/m$^2$ from the viewpoint of suppression of iron dissolution from dented parts of the film laminate or coating. If the amount of tin plating is less than 0.5 g/m$^2$, the amount of iron dissolution after denting becomes greater and the corrosion resistance falls, so this may not be preferred. On the other hand, even if the amount of tin plating exceeds 12.0 g/m$^2$, the functions are not particularly obstructed, but in the production process, the tin easily sticks to and builds up on the rolls etc., and causes dents or the plating costs swells more than necessary. Thus, this may not be preferred.

<Treatment for Removal of Tin Oxide>

The environmentally friendly steel sheet for a container material according to the present invention may not necessarily be a plated steel sheet. However, in order to secure a sufficient corrosion resistance with respect to contents to be contained in a container material, the surface of the side of the container material to be in contact with the contents after the can manufacturing may preferably be plated with tin or an iron-tin alloy. When the tin oxide layer present on the surface of a tin-plated steel sheet is too thick, even in the case of the formation of a zirconium compound-containing coating film on the tin oxide layer, the tin oxide layer so fragile that the coating may be peeled off together with the tin oxide layer, to thereby deteriorate the coating adhesion. Accordingly, it is preferred to remove the tin oxide layer, immediately before the cathodic electrolytic coating treatment.

FIG. 1 is a graph showing the results of evaluating the coating adhesion in terms of T-peel strength appearing hereinafter by using a zirconium compound-containing coating film having an amount converted to zirconium of 2 to 4 mg/m2 which has been formed by using a zirconium sulfate electrolytic treatment on a tin-plated steel sheet (tin coating amount on one side: 2.8 g/m2) which has been subjected to a tin oxide removal treatment while changing the immersion time in sulfuric acid.

As can be seen from FIG. 1, when the amount of tin oxide on the tin plating is in the range of 0 mC/cm$^2$ to 3.5 mC/cm$^2$ measured by the electrolytic stripping method, the coating adhesion is stable at a T-peel strength of 60 or more. On the other hand, when the amount of tin oxide exceeds 3.5 mC/cm$^2$, the coating adhesion is abruptly decreased. It is presumed that an increase in the amount of tin oxide reduces the wettability of the surface, and accordingly the zirconium compound-containing coating film is not deposited uniformly during the electrolytic coating treatment of zirconium sulfate, to thereby decrease the strength of coating adhesion. When the amount of tin oxide on the tin plating exceeds about 3.5 mC/cm$^2$, the tin plating comes to be entirely covered with the tin oxide layer, and accordingly the tin oxide may easily be peeled off from the fragile tin oxide layer, at the time of the forming thereof or under the application of an impact. It is presumed that such a phenomenon causes a decrease in the coating adhesion.

For the above reasons, in order to stabilize the attachment of a zirconium compound on the tin-plated layer or the iron-tin alloy layer, it is preferred to remove the tin oxide layer of the tin-plated steel sheet so as to provide a level thereof of 3.5 mC/cm$^2$ or less measured by the electrolytic stripping method.

From the viewpoint of improvement in the adhesion of the film or coating, it is preferred that no tin oxide layer is present at all. However, even if the tin oxide layer is completely removed, the tin will be oxidized at the uppermost surface, provided that there is even a little oxygen present. Therefore, the film lamination or coating of the tin plated surface in a state where no tin oxide is present at all, is difficult by ordinary facilities. Even if this could be realized, the manufacturing costs would swell, so this may not be preferred.

If the tin oxide layer on the tin plating is removed to 0.01 mC/cm$^2$, an equivalent adhesion may be obtained as the state thereof with substantially no tin oxide layer, so the thickness of the tin oxide layer may preferably be in the range from 0.01 mC/cm$^2$ to 3.5 mC/cm$^2$. If the manufacturing costs is not considered, the most preferable lower limit of the thickness of the tin oxide layer is 0 (mC/cm$^2$). The more preferable upper limit of the thickness of the tin oxide layer may be 3.0 (mC/cm$^2$) (mC/cm$^2$).

Herein, the electric stripping method refers to a method of applying the principle of constant current coulometry for constant current electrolysis of a test piece, wherein the change in potential of the test piece accompanying electric stripping is recorded by using a pen recorder, and the amount of electricity, (that is, the amount of deposition of surface tin and the oxide film) is measured from the electrolysis time-potential curve.

As the method of removing the tin oxide layer which has been formed on a tin-plating layer or iron-tin alloy layer, it is most desirable to use a treatment by using cathodic electrolysis in a sodium carbonate or sodium hydrogen carbonate solution, since the tin oxide layer may reliably be removed in a short time and almost no tin dissolving-out is observed.

When a tin-plated steel sheet is subjected to cathodic electrolysis in an aqueous solution of sodium carbonate or sodium hydrogen carbonate, the concentration range of sodium carbonate or sodium hydrogen carbonate may preferably be 1 mass % to 5 mass %. When the concentration of the aqueous solution of sodium carbonate or sodium hydrogen carbonate is less than 1 mass %, the tin oxide layer may sometimes remain and accordingly this may not be preferred. When the concentration of the aqueous solution of sodium carbonate or sodium hydrogen carbonate exceeds 5 mass %, sufficient washing with water may be required after the treatment, otherwise the sodium carbonate or sodium hydrogen carbonate may sometimes remain, and accordingly this may not be preferred. When the solution temperature during the electrolytic coating treatment is low, the solubility of sodium carbonate or sodium hydrogen carbonate becomes lower, and accordingly the solution temperature may preferably be 5° C. or more. The upper limit of the solution temperature is not particularly limited, and any temperature can be used as long as it does not make the handling thereof dangerous.

When the current density during the cathodic electrolysis is too low, the removal of the tin oxide layer may become uneven, and accordingly the treatment with 1 $A/dm^2$ or more of the current density may be preferred. The upper limit of the current density is not be particularly limited, but when the current density is too high, the removal efficiency of tin oxide does not considerably be changed, despite the presence of vigorous generation of hydrogen, and accordingly about 10 $A/dm^2$ or less may be preferred.

Further, it is also preferred to use a method of removing the tin oxide layer which has been formed on a tin-plated layer or the iron-tin alloy layer by the immersion thereof in an aqueous sulfuric acid solution. The concentration of the aqueous sulfuric acid solution may preferably be 0.5 mass % or more and 5 mass % or less. When the concentration of the aqueous sulfuric acid solution is less than 0.5 mass %, the tin oxide layer cannot be fully removed and accordingly this may not be preferred. The higher the concentration of the aqueous sulfuric acid solution, the easier the tin oxide is removed. However, a higher concentration thereof may cause rough skin or the residual sulfuric acid so as to reduce the coating adhesion, and accordingly the upper limit of the concentration of the aqueous sulfuric acid solution may preferably be 5 mass % or less. The temperature of the aqueous sulfuric acid solution may preferably be in the range of 10° C. or more and 80° C. or less. When the liquid temperature of the aqueous sulfuric acid solution is less than 10° C., the rate of removing tin oxide becomes very low, and tin oxide may sometimes remain, and accordingly, this may not be preferred. On the other hand, when the temperature of the aqueous sulfuric acid solution exceeds 80° C., the rate of removing tin oxide becomes significantly high, and the tin-plated surface may excessively be etched, so as to provide uneven gloss, and accordingly, this may not be preferred.

<Treatment with Zirconium Compound>

In the cathodic electrolytic coating treatment according to the present invention, a tin-plated steel sheet or an iron-tin alloy plated steel sheet is subjected to a cathodic electrolytic coating treatment in an aqueous solution of an alkali metal sulfate which does not contain a chromium compound, fluorine or nitrate nitrogen, but contains a zirconium compound, wherein the zirconium concentration in the cathodic electrolytic coating treatment solution is 10 mg/L or more and 2000 mg/L or less, the electric conductivity of the treatment solution is 0.2 S/m or more and 6.0 S/m or less, and the pH of the treatment solution is 1.5 or more and 2.5 or less.

The purpose of using a zirconium compound as a primer agent is to coat the surface of a steel sheet with a zirconium oxide hydrate, so as to form hydrogen bonding between the zirconium oxide hydrate and hydroxy groups contained in the resin coating layer, similarly as in the case of the chromate treatment, to thereby enhance the adhesion with the resin coating film.

For the purpose of obtaining an effect similar to that of a zirconium compound, the present inventors have examined various metal-based oxides for suitability as the cathodic electrolytic coating treatment agent. As a result, the present inventors have found that the cathodic electrolytic coating treatment with a zirconium compound provided the best adhesion with a resin coating film (particular, in view of the secondary adhesion after retort treatment). As a metal salt not containing a chromium compound, fluorine or nitrate nitrogen to be used in the process of depositing a zirconium compound by using a cathodic electrolytic coating treatment, it is possible to use a carbonate, a sulfate, a halogenated salt. Among these, zirconium sulfate may be most preferred, since its aqueous solution is stable, and industrially easily available.

As the process of forming a zirconium compound into a cathodic electrolytic coating treatment layer, it is general to use a cathodic electrolytic coating treatment in an aqueous solution of zirconium fluoride. Since a fluoride-containing bath has a heavy load to the waste treatment to be used therefor, Patent Document 3 as mentioned above proposes the use of zirconium sulfate in stead of a zirconium fluoride compound, in the cathodic electrolytic coating treatment.

However, the method of forming a coating film by the cathodic electrolytic coating treatment of a sulfate compound has a characteristic that the deposition of a zirconium oxide hydrate is markedly changed depending on the current density, and accordingly it is difficult to keep the coating amount of a zirconium oxide hydrate in an appropriate range. When the coating amount of the coating film of a zirconium oxide hydrate is changed, it causes unevenness in the coating adhesion and film adhesion, and accordingly this may not be preferred.

Further, the aqueous zirconium sulfate solution has a problem in storage stability, that is, when a high concentration zirconium solution is stored at a high temperature (40° C. or higher) for a long time, precipitates of a zirconium oxide hydrate is liable to be formed.

In view of these problems, in the present invention, a zirconium compound is added to an aqueous solution of an alkali metal sulfate, so that the deposition behavior of the zirconium oxide hydrate is stabilized with respect to the current density during the cathodic electrolytic coating treatment, as well as the storage stability of the solution is enhanced. As a result, the unevenness in the coating amount of a zirconium oxide hydrate can be reduced or obviated, even when the operation condition slightly is changed to a certain extent, and accordingly a drastic enhancement in the stability of the solution is attained during a long-time use.

First, a mechanism of forming a zirconium oxide hydrate coating by cathodic electrolytic coating treatment of a tin-plated steel sheet in an aqueous solution of alkali metal sulfate containing a zirconium compound will be explained (hereinafter, there will be described an embodiment using "an aqueous solution of zirconium sulfate to which sodium sulfate has been added" as an example).

It is presumed that zirconium is be present as $ZrO^{2+}$ in an aqueous sodium sulfate solution. It is also presumed that $ZrO^{2+}$ is stable at a low pH region, but the stability of $ZrO^{2+}$ becomes lower as pH becomes higher, so that it is liable to be deposited as a hydrated oxide.

When sodium sulfate is subjected to a cathodic electrolytic coating treatment, hydrogen gas is generated at the interface with the solution at the tin-plated steel sheet side of the cathode, and as a result, the hydroxide ion concentration in the vicinity of the interface may become higher (i.e., pH id increased). It is presumed that, when the pH of the interface becomes higher, $ZrO^{2+}$ begins to be deposited as a hydrated oxide, and a coating film of zirconium oxide hydrate is formed on the tin-plated steel sheet.

Then, the effect of adding a zirconium compound to an aqueous sodium sulfate solution will be explained.

As described above, when a tin-plated steel sheet is subjected to a cathodic electrolytic treatment in an aqueous zirconium sulfate solution, the interface pH is increased so as to form a zirconium hydroxide coating film. Since the diffusion rate of ions in an aqueous solution is slow, it is presumed that a significantly thick high-pH layer is formed in the vicinity of the interface, and when the interface pH reaches a condition for the deposition of zirconium hydroxide, a zirconium oxide hydrate coating film is formed abruptly. Accordingly, in a cathodic electrolysis solution comprising a zirconium sulfate alone, it is expected that the coating amount of the zirconium hydroxide coating film may be changed markedly depending on variation in current density or pH.

As a first effect of using an aqueous solution of an alkali metal sulfate as a base solution, the aqueous solution of the alkali metal sulfate acts as an electrolyte, and it reduces the electric resistance of the solution. This has an effect of reducing the burden or load to the rectifier.

As a second effect, the alkali metal ion neutralizes the hydroxide ions which have been formed at the interface of the tin-plated steel sheet and the cathodic electrolytic solution by the cathodic electrolytic treatment, so that a high pH layer having an appropriate thickness can be formed on the interface, to thereby provide an effect of suppressing the variation in the coating amount of the zirconium hydroxide coating film due to the variation in the current density variation or in the pH (specifically, in a case where ions such as $Na^+$ and $K^+$ are present in large quantities near the electrode).

Then, there is described the effect on the coating amount in the cathodic electrolytic treatment and the current density during the cathodic electrolytic treatment, and on the pH of the solution, in a case where an aqueous zirconium sulfate solution alone is subjected to cathodic electrolytic treatment of the prior art, and in a case where an aqueous solution of an alkali metal sulfate containing a zirconium compound according to the present invention is subjected to cathodic electrolytic treatment.

Figure 2:
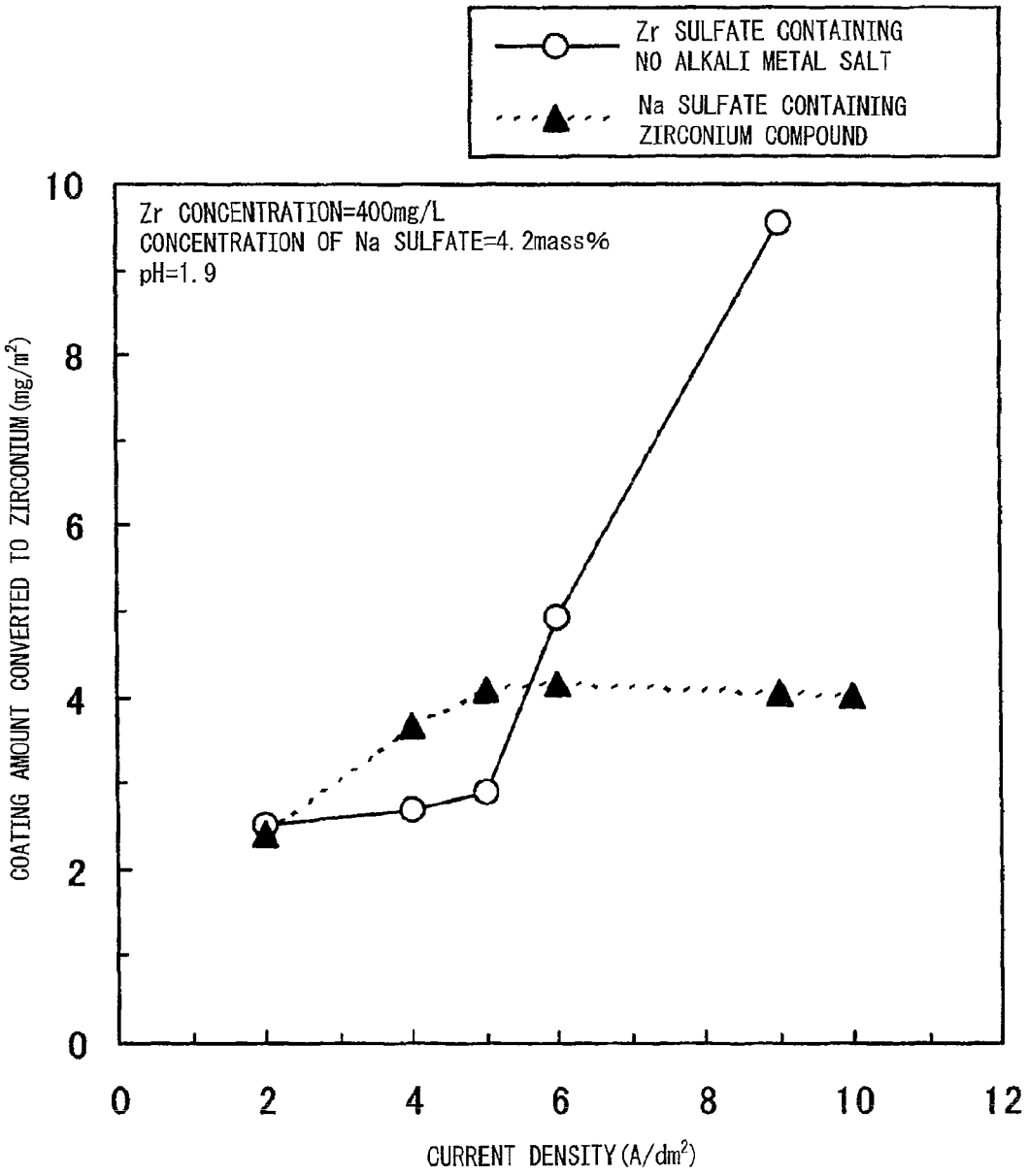
FIG. 2 is a graph showing a relationship between the current density during an electrolytic treatment and the film coating amount converted to zirconium of a primer coating film in the case of a conventional zirconium sulfate treatment solution, and in the case of a sodium sulfate treatment solution containing a zirconium compound according to the present invention.

FIG. 2 is a graph showing a relationship between the current density during the cathodic electrolytic coating treatment and the zirconium compound coating amount which has been deposited to the steel sheet, when a tin-plated steel sheet (amount of tin-plating: 2.8 g/$m^2$) which has been subjected to a tin oxide removal treatment, is subjected to a cathodic electrolytic coating treatment, by using an aqueous solution, wherein zirconium sulfate has been added to a 4.2 mass %-aqueous sodium sulfate solution so as to provide a concentration converted to zirconium of 400 mg/L, and the pH thereof has been regulated to 1.9 by the addition of sulfuric thereto.

As can be seen from FIG. 2, in a case where the cathodic electrolytic coating treatment is performed in a treatment solution comprising zirconium sulfate alone, the increasing rate of the coating amount of the zirconium compound-containing coating film is small in the low current density region, but the increasing rate of the coating amount of the zirconium compound-containing coating film tends to be increased abruptly at a specific current density. In contrast thereto, in a case where a sodium sulfate treatment solution to which zirconium compound has been added is used, the variation in the coating amount of the zirconium compound with respect to an increase in the current density is small (i.e., the degree of increase in the coating amount of the zirconium compound-containing coating film with respect to the increase in the current density is moderate), and accordingly, this operational stability is high and preferable.

The alkali metal sulfate may appropriately be selected from sodium sulfate and potassium sulfate, since both of them give a similar effect.

As describe above, in a chromium-free treatment process according to the present invention wherein a zirconium compound is added to an aqueous solution of an alkali metal sulfate such as sodium sulfate and potassium sulfate, even if the current density condition may be changed to a certain extent, the variation in the coating amount of a zirconium compound-containing coating film is small, and a stable operation can be realized.

Figure 3:
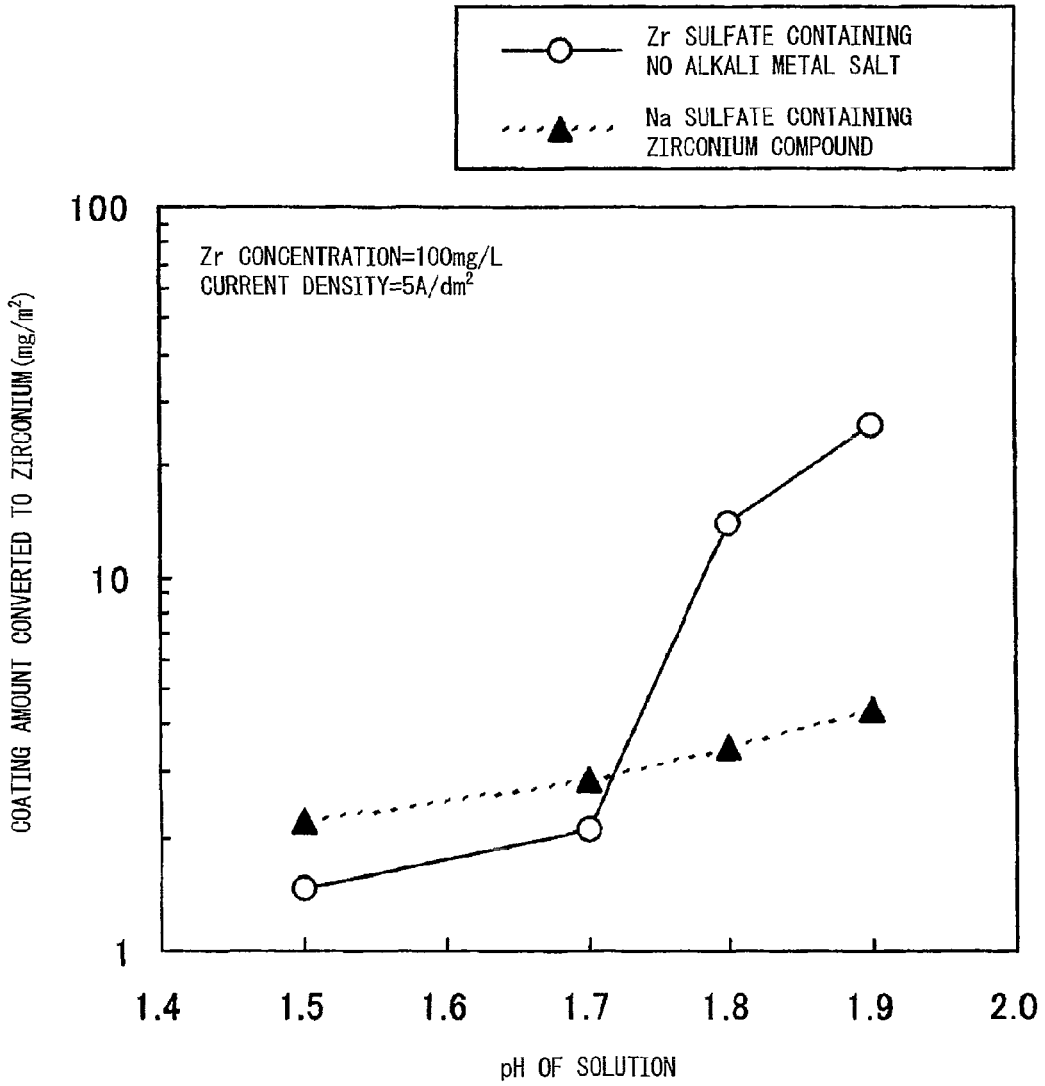
FIG. 3 is a graph showing a relationship between the pH of a treatment solution and the film coating amount converted to zirconium of a primer coating film disposed on a tin-plated steel sheet after electrolytic treatment, in the case of a conventional zirconium sulfate treatment solution, and in the case of a sodium sulfate treatment solution containing a zirconium compound according to the present invention.

FIG. 3 is a graph showing a relationship between the pH of a solution and the amount of the zirconium compound-containing coating film on a tin-plated steel sheet, when the tin-plated steel sheet is subjected to a cathodic electrolytic coating treatment at a current density of 5 A/$dm^2$ for 5 seconds, by using an aqueous zirconium sulfate solution wherein the pH has been lowered by adding sulfuric acid to an aqueous zirconium sulfate solution of pH 1.9, and an aqueous sodium sulfate solution containing a zirconium compound wherein pH is raised by mixing sodium sulfate with an aqueous zirconium sulfate solution of pH 1.6.

As can be seen from FIG. 3, in a case where the cathodic electrolytic coating treatment is performed in a treatment solution containing zirconium sulfate alone, a change in pH leads to extreme variation in the coating amount of the zirconium compound-containing coating film. On the other hand, in the case of an aqueous sodium sulfate solution containing a zirconium compound, even when pH is changed, the variation in the coating amount of the zirconium compound-containing coating film is small. Accordingly, in this case, even if pH is lowered by a continuous cathodic electrolytic coating treatment, the coating amount of the zirconium compound-containing coating film does not show an abrupt decrease. That is, the coating amount is stable.

As described above, as compared to an aqueous zirconium sulfate solution, in the case of a solution wherein a zirconium compound is added to an aqueous solution of an alkali metal sulfate such as sodium sulfate and potassium sulfate, the variation in the coating amount of the zirconium compound-containing coating film is small with respect to a change in the electrolytic condition, and accordingly it is easy to keep the coating amount of the zirconium compound-containing coating film in an appropriate range, and stable production can be attained.

With regard to the concentration of the alkali metal sulfate of an aqueous solution of the alkali metal sulfate containing a zirconium compound, the alkali metal sulfate may be deposited in an environment of 5° C. or less, and accordingly the upper limit of the concentration of the alkali metal sulfate may preferably be 8.0 mass % or less.

With regard to the lower limit of concentration of the alkali metal sulfate in an aqueous solution of the alkali metal sulfate containing a zirconium compound, the alkali metal sulfate may not be required, as long as the optimum range of the electric conductivity and the optimum pH of the solution appearing hereinafter are to be satisfied. However, with the aqueous zirconium sulfate solution alone, as described hereinabove, not only the coating amount of the zirconium compound-containing coating film may become unstable with respect to variation in the electrolysis condition, but also the presence of the alkali metal ion in an aqueous solution can enhance the stability of the solution, and accordingly, the alkali metal sulfate is essential. Incidentally, when the lower limit of the zirconium concentration in an aqueous zirconium sulfate solution is 10 mg/L and the upper limit of pH is 2.5, 0.1 mass % of the alkali metal sulfate may be required, and accordingly the lower limit range of the concentration of the alkali metal sulfate may be 0.1 mass %.

Then, an appropriate range of the coating amount of the zirconium compound-containing coating film will be explained.

Since the coating material adhesion of a tin-plated steel sheet to which a zirconium compound-containing coating film has been applied by a cathodic electrolytic coating treatment may be changed depending on the coating amount of the zirconium compound-containing coating film, it is important to clarify the appropriate range of the coating amount of the zirconium compound-containing coating film.

Figure 4:
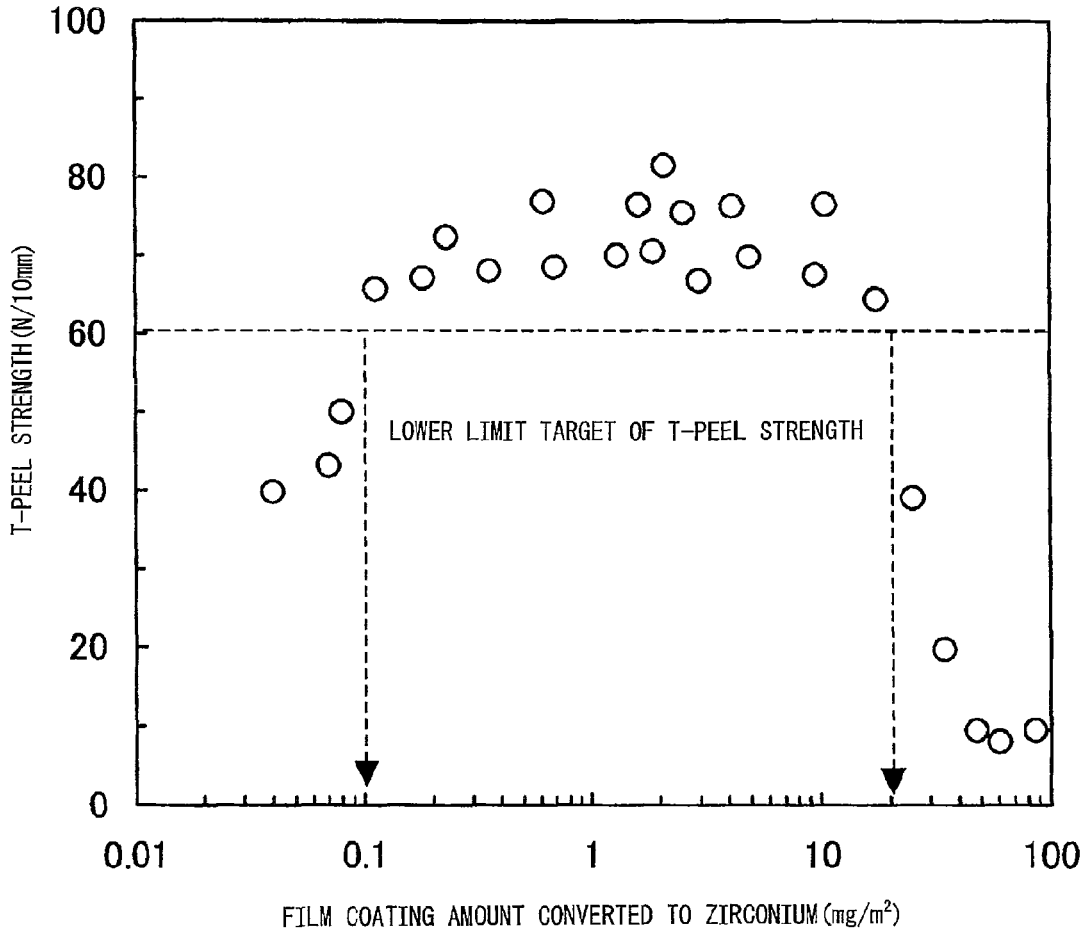
FIG. 4 is a graph showing a relationship between the film coating amount converted to zirconium of a primer coating film, and the coating material adhesion (T-peel strength) of a tin-plated steel sheet, which has been subjected to an electrolytic treatment with a sodium sulfate treatment solution containing a zirconium compound according to the present invention.

FIG. 4 is a graph showing a relationship between the film coating amount converted to zirconium and the coating material adhesion after coating of a tin-plated steel sheet which has been subjected to a cathodic electrolytic coating treatment in an aqueous zirconium sulfate solution. Herein, the coating material adhesion is evaluated by using the T-peel strength appearing hereinafter.

As can be seen from FIG. 4, the T-peel strength is stable at 60 N/10 mm or more in the range of a film coating amount converted to zirconium of 0.1 mg/m$^2$ to 20 mg/m$^2$. However, in the zirconium compound-containing coating film amount outside of this range, the T-peel strength is not stable and a sufficient forming adhesion after the coating cannot be obtained.

Then, the concentration of zirconium to be contained in the cathodic electrolytic coating treatment solution according to the present invention will be explained.

Figure 5:
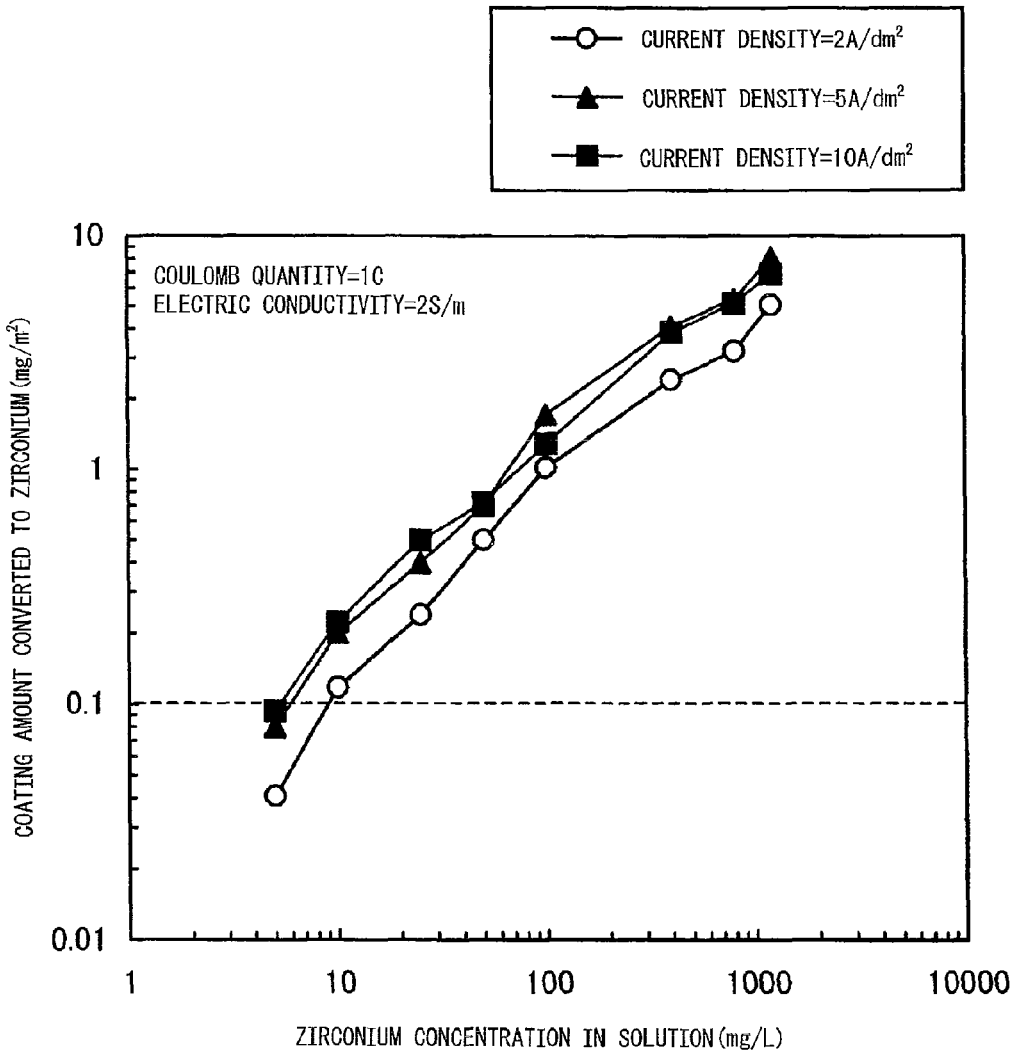
FIG. 5 is a graph showing a relationship between the zirconium concentration of an aqueous sodium sulfate solution containing a zirconium compound according to the present invention, and the film coating amount converted to zirconium of a coating film containing a zirconium compound.

As shown in FIG. 5, in a case where the concentration of zirconium contained in the cathodic electrolytic coating treatment solution according to the present invention is less than 10 mg/L, for example at a low current density such as 2 A/dm$^2$, the coating amount of the zirconium compound-containing coating film after the cathodic electrolytic coating treatment may become lower than the lower limit as describe above of 0.1 mg/m$^2$ of the film coating amount converted to zirconium, and accordingly this may not be preferred.

Therefore, the zirconium concentration in an aqueous solution of an alkali metal sulfate containing a zirconium compound may preferably be 10 mg/L or more.

Figure 6:
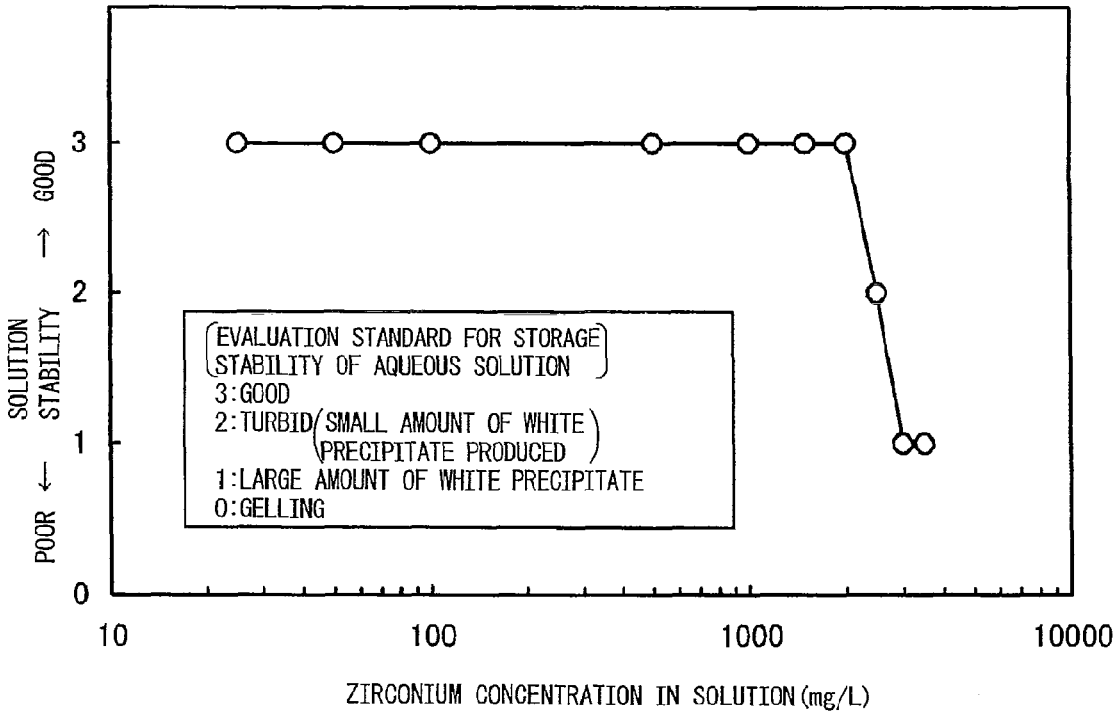
FIG. 6 is a graph showing a relationship between the zirconium concentration, and the storage stability of a treatment solution according to the present invention.

On the other hand, when the concentration of zirconium contained in the cathodic electrolytic coating treatment solution exceeds 2000 mg/L, the storage stability of the solution may be reduced, and after a long-time storage, the sludge of zirconium oxide hydrate may be deposited as shown in FIG. 6, and this may not be preferred.

Further, when the concentration of zirconium contained in the cathodic electrolytic coating treatment solution exceeds 2000 mg/L, the zirconium compound-containing coating film on the steel sheet surface tends to be uneven, and sludge tends to be formed during the electrolytic treatment, and accordingly this may not be preferred. When the concentration of an aqueous zirconium sulfate solution is high, the amount of the solution to be taken out during a continuous threading operation becomes large, and this is not economical.

For the above reasons, the concentration of zirconium contained in the cathodic electrolytic coating treatment solution according to the present invention may preferably be 10 mg/L or more and 2000 mg/L or less.

The electric conductivity of the cathodic electrolytic coating treatment solution according to the present invention may be changed depending on the concentration of an aqueous solution of an alkali metal sulfate, the amount of a zirconium compound and pH, but an appropriate range of the electric conductivity is 0.2 S/m or more and 6.0 S/m or less. Hereinbelow, the reasons therefor will be explained in FIG. 7 and FIG. 8.

Figure 7:
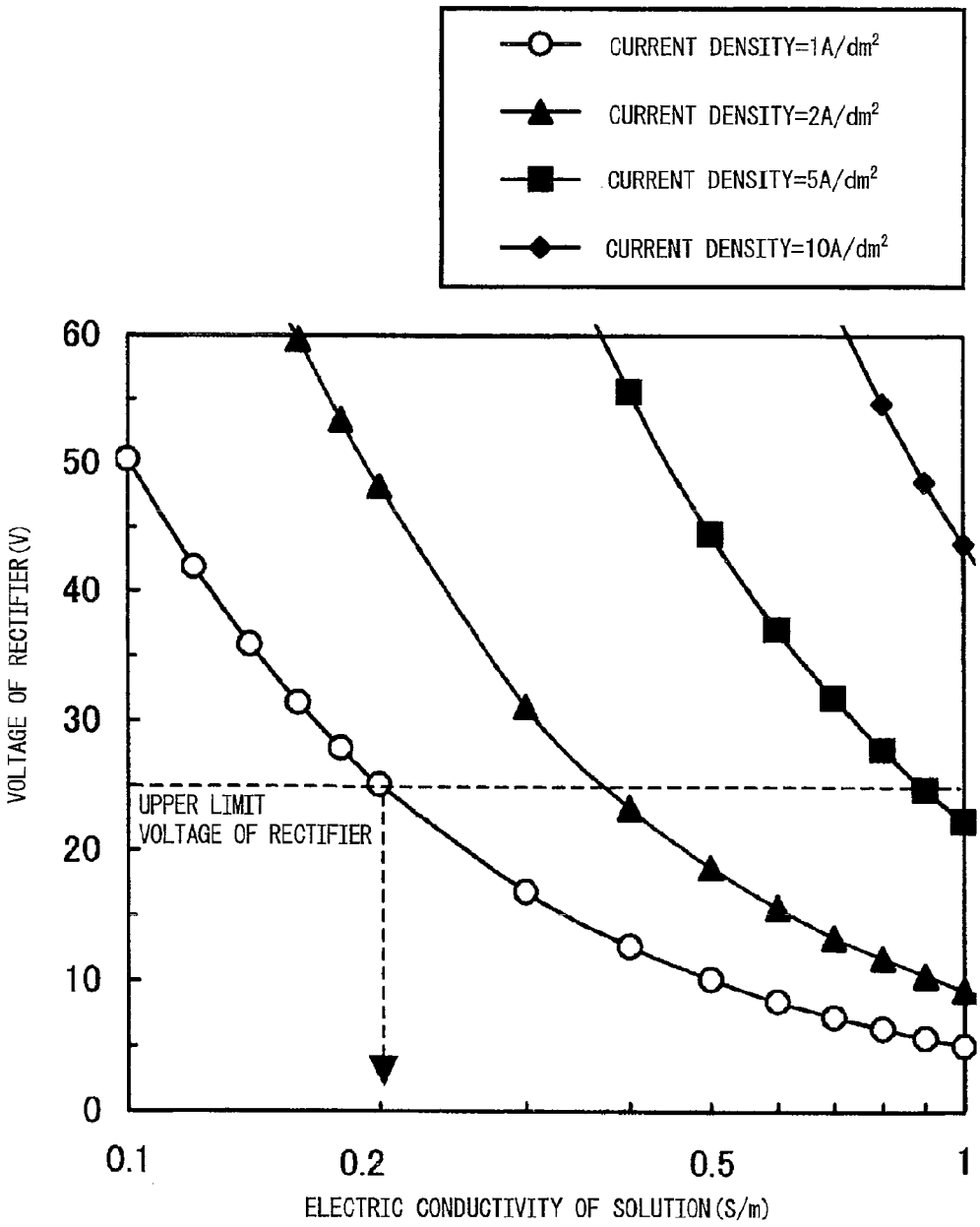
FIG. 7 is a graph showing a relationship between the electric conductivity of a treatment solution, and the rectifier voltage during electrolysis, when sodium sulfate treatment solution containing a zirconium compound having different electric conductivities according to the present invention are electrolyzed while changing the current density.

FIG. 7 is a graph showing a relationship between the electric conductivity of a solution and the rectifier voltage, when the cathodic electrolytic coating treatment of a tin-plated steel sheet is performed by the changing current density from 1 A/dm$^2$ to 10 A/dm$^2$ by using a solution having a zirconium concentration of 10 mg/L and pH of 1.9, wherein the electric conductivity is changed by changing the concentration of an aqueous solution of sodium sulfate. As can be seen from FIG. 7, when the electric conductivity of the solution becomes lower than 0.2 S/m, the voltage of the rectifier comes to exceed 25 V, even if the current density is 1 A/dm$^2$, to thereby increase the load on the rectifier.

In view of the use of the present chromium plating equipment as it is without changing the electrode length or the electrolytic treatment path number, the voltage during the operation should be about 25 V at the highest, since the upper limit of voltage of the actual rectifier is generally about 25 V.

On the other hand, if the predetermined value of the current density is lowered, the voltage can be lowered. However, an excessively low current density can make the depositing property of a zirconium compound unstable, and this may not be preferred, but about 1 A/dm$^2$ at the lowest may be preferred. Thus, as can be suggested from FIG. 7, the lower limit of the electric conductivity of an electrolytic solution may preferably be 0.2 S/m or more.

An optimum current density when a tin-plated steel sheet or an iron-tin alloy-plated steel sheet is subjected to a cathodic electrolytic coating treatment by using the cathodic electrolytic coating treatment solution according to the present invention may appropriately be selected based on the coating amount of a zirconium compound-containing coating film which is to be deposited on the tin-plated steel sheet or the iron-tin alloy-plated steel sheet. However, if the current density is too high, the hydrogen generation from the steel sheet side as a cathode side becomes vigorous, and accordingly the deposited zirconium compound may be peel off by the thus generated hydrogen gas, whereby uneven coating is liable to be caused. Accordingly, the electrolytic treatment at about 30 A/dm$^2$ or less may be preferred.

Then, the upper limit of the electric conductivity of the cathodic electrolytic coating treatment solution according to the present invention will be explained.

When the concentration of an aqueous solution of an alkali metal sulfate in the cathodic electrolytic coating treatment solution according to the present invention is increasingly raised, the load to the rectifier becomes smaller, and accordingly the current density can be raised. However, if the electric conductivity becomes too high, the coating amount of zirconium compound-containing coating film tends to be decreased, to thereby cause an uneven outer appearance, which may not be preferred.

Figure 8:
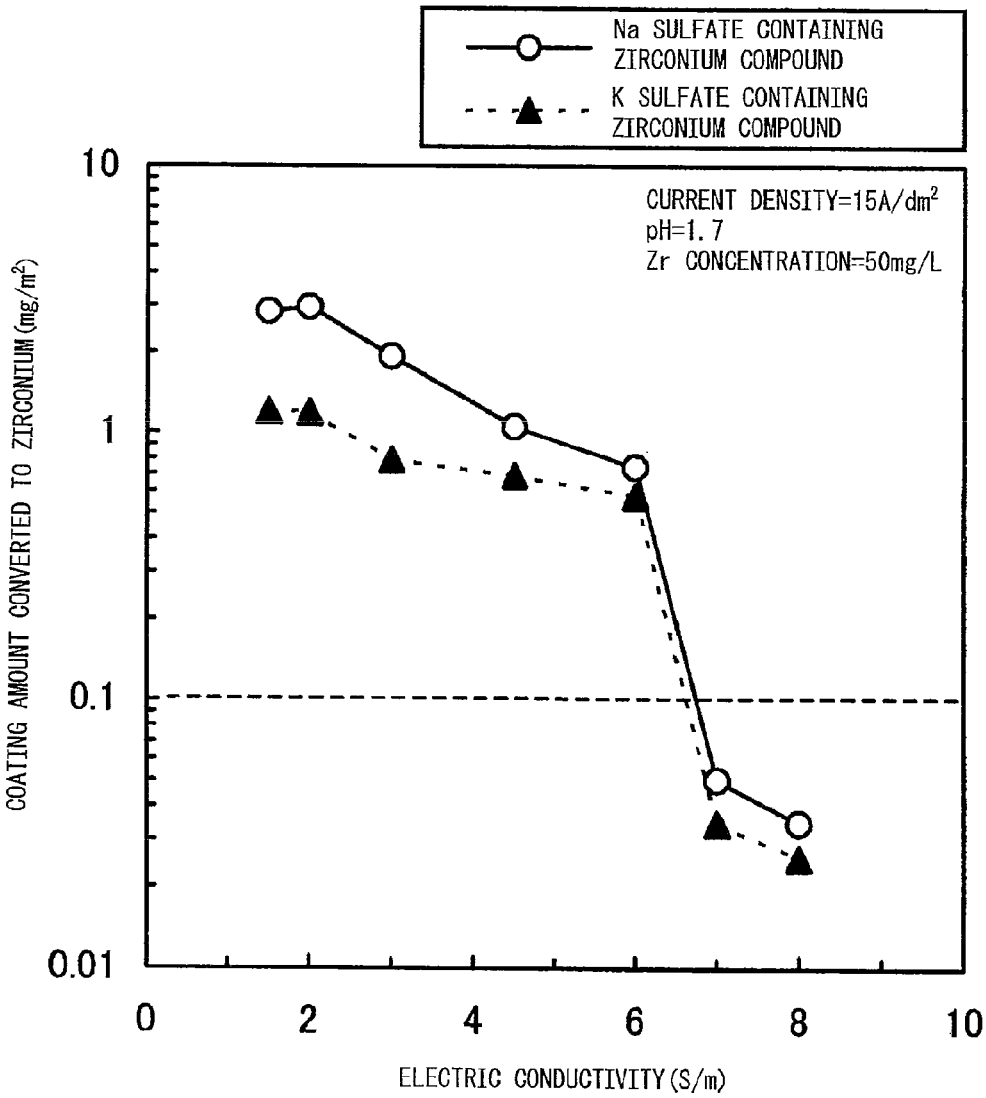
FIG. 8 is a graph showing a relationship between the electric conductivity of a treatment solution, and the film coating amount converted to zirconium of a primer coating film, when each of a sodium sulfate treatment solution containing a zirconium compound, or a potassium sulfate treatment solution containing a zirconium compound according to the present invention having different electric conductivities is electrolyzed.

FIG. 8 is a graph showing the electric conductivity of the solution, and the coating amount converted to zirconium of a zirconium compound, when a tin-plated steel sheet or a iron-tin alloy-plated steel sheet is subjected to a cathodic electrolytic coating treatment at a current density of 15 A/dm$^2$ using a solution with a zirconium concentration of 50 mg/L and pH of 1.7, wherein the electric conductivity is changed by changing the concentration of an alkali metal sulfate in an aqueous sodium sulfate solution containing a zirconium compound, or an aqueous potassium sulfate solution containing a zirconium compound.

As can be seen from FIG. 8, the coating amount of the zirconium compound-containing coating film tends to be decreased, as the electric conductivity of the solution comes to exceed about 6.0 S/m.

In the reaction at the cathode side where no alkali metal ions are present, hydrogen ions first receive electrons to become hydrogen gas to be released, and the hydroxide ion concentration at the interface is increased (i.e., pH is increased), and as a result, zirconium oxide ions ($ZrO^{2+}$) are deposited as zirconium oxide hydrate. In contrast thereto, it is presumed, when alkali metal ions are present, Na ions also participate in the transfer of electrons at the cathode interface (while the deposited metal Na is immediately dissolved and dissociated), and accordingly as compared to a case where no alkali metals are added, the concentration of hydroxide ions which have been formed at the interface becomes lower, whereby the deposition of zirconium oxide hydrates is inhibited.

Accordingly, if the electric conductivity is excessively increased by adding the alkali metal ions, the interface pH at the cathode side is less liable to be increased, and the deposition of zirconium hydroxides becomes more difficult. Accordingly, the electric conductivity of the solution may preferably be 6.0 S/m or less.

Next, the optimum pH range of the cathodic electrolytic coating treatment solution according to the present invention will be explained.

Figure 9:
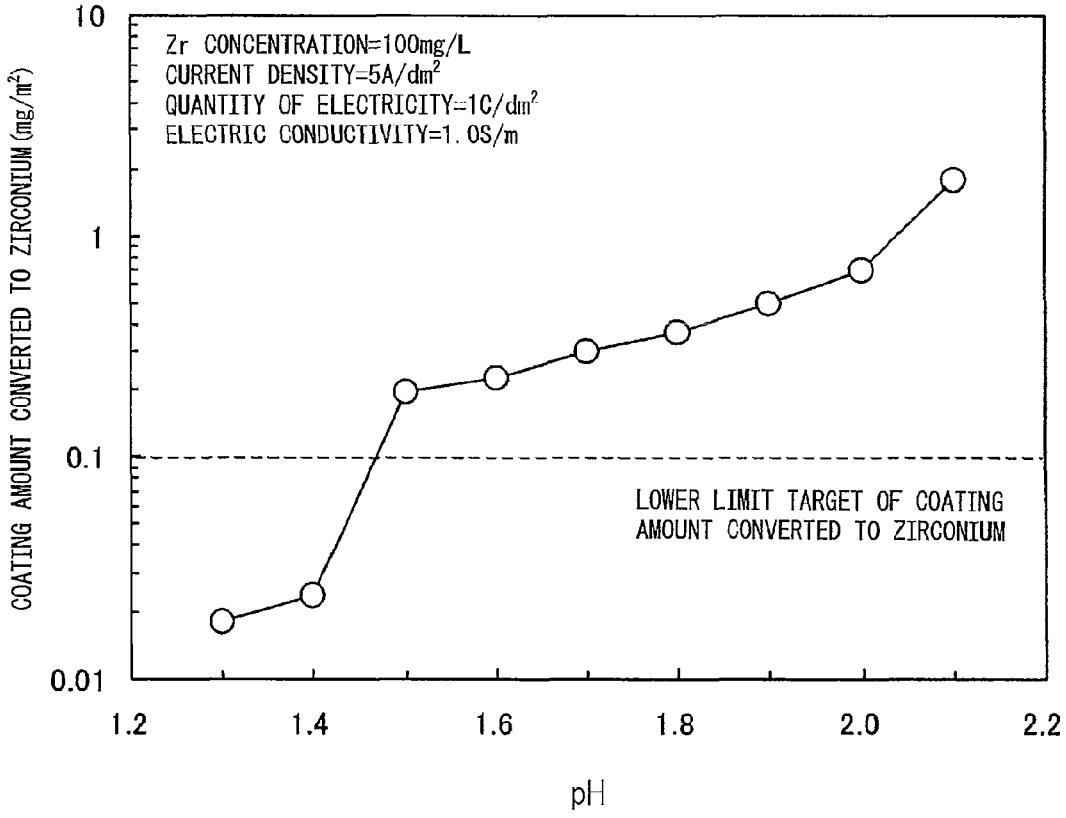
FIG. 9 is a graph showing a relationship between the pH of a treatment solution, and the film coating amount converted to zirconium of a primer coating film, when sodium sulfate treatment solutions containing a zirconium compound according to the present invention having different pH are electrolyzed.

With regard to the lower limit of pH of the cathodic electrolytic coating treatment solution according to the present invention, when the pH becomes lower, as shown in FIG. 9, the coating amount of the zirconium compound-containing coating film tends to be decreased, and at less than pH 1.5, the film coating amount converted to zirconium does not reach the lower limit target of 0.1 $mg/m^2$, and accordingly this may not be preferred.

It is presumed that the mechanism of the deposition of the zirconium compound-containing coating film is the deposition of zirconium oxide hydrate due to an increase in the concentration of hydroxide ions (i.e., an increase in pH) at the interface caused by the hydrogen gas generation during the cathodic electrolytic treatment, and when the pH of the cathodic electrolytic coating treatment solution is low, the hydroxide ion concentration at the cathode cannot be increased, and as a result, the formation of the coating film of the zirconium oxide hydrate becomes difficult.

When the amount of the zirconium oxide hydrate deposited is small, the lower limit (a film coating amount converted to zirconium of 0.1 $mg/m^2$ or more) of the amount of the zirconium compound-containing coating film capable of giving the favorable adhesion of the coating material cannot be obtained, and this may not be preferred.

Accordingly, the lower limit of pH of the cathodic electrolytic solution according to the present invention may preferably be 1.5 or more.

Then, the upper limit of pH of the cathodic electrolytic coating treatment solution according to the present invention will be explained.

Figure 10:
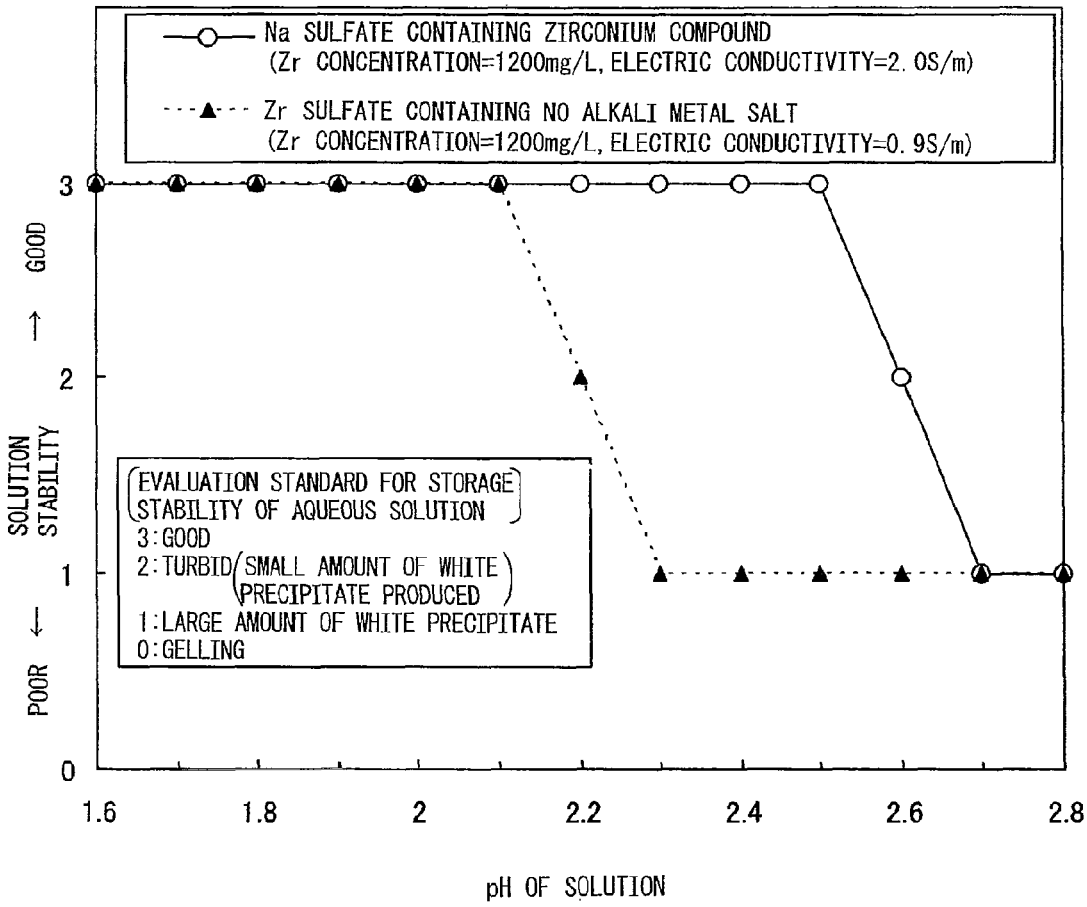
FIG. 10 is a graph which shows the storage stability of sodium sulfate treatment solutions containing a zirconium compound according to the present invention having different pH which have been allowed to stand at 40° C. for 2 weeks, and shows a relationship between the pH and the results of storage stability evaluation of the solutions.

FIG. 10 is graph showing the storage stability (which has been evaluated from the presence or absence of precipitate generation in a solution which has been allowed to stand at 40° C. for 2 weeks) of an aqueous solution of sodium sulfate containing a zirconium compound, and an aqueous solution comprising zirconium sulfate alone. As can be seen from FIG. 10, in the aqueous solution comprising zirconium sulfate alone, the storage stability of the solution is decreased when pH exceeds 2.1.

In an aqueous zirconium sulfate solution, zirconium is present in the form of $ZrO^{2+}$. Accordingly, it is considered that as the pH becomes higher, $ZrO^{2+}$ tends to be deposited in the form of a hydrated oxide, and when an aqueous zirconium sulfate solution having a high pH is stored for a long time or at a high temperature, $ZrO^{2+}$ ions which have been dissolved in the solution are deposited as a zirconium oxide hydrate, and the resultant deposition becomes a white precipitate.

On the other hand, in the case of an aqueous sodium sulfate solution containing a zirconium compound as shown in FIG. 10, it is found that the upper limit of the stable pH region of the solution is extended to pH 2.5. This is probably because, in the aqueous solution of an alkali metal sulfate, hydroxide ions are coordinated with the dissociated alkali metal ions, and as a result, the number of hydroxide ions to be coordinated with $ZrO^{2+}$ become smaller, to thereby enhance the stability of $ZrO^{2+}$.

In the case of an aqueous solution of sodium sulfate containing a zirconium compound, a white precipitate may be formed at a pH of 2.5 as the upper limit, and accordingly the pH may preferably be 2.5 or less.

Further, when a continuous electrolytic treatment operation is performed by using a high-pH solution, sludge is liable to be formed in a large amount, and accordingly also in view of the operability and product quality, the pH may preferably be 2.5 or less.

As an alkali metal sulfate to be used in the cathodic electrolytic coating treatment solution according to the present invention, sodium sulfate and potassium sulfate may be preferred in view of easy availability and easy handling.

Figure 11:
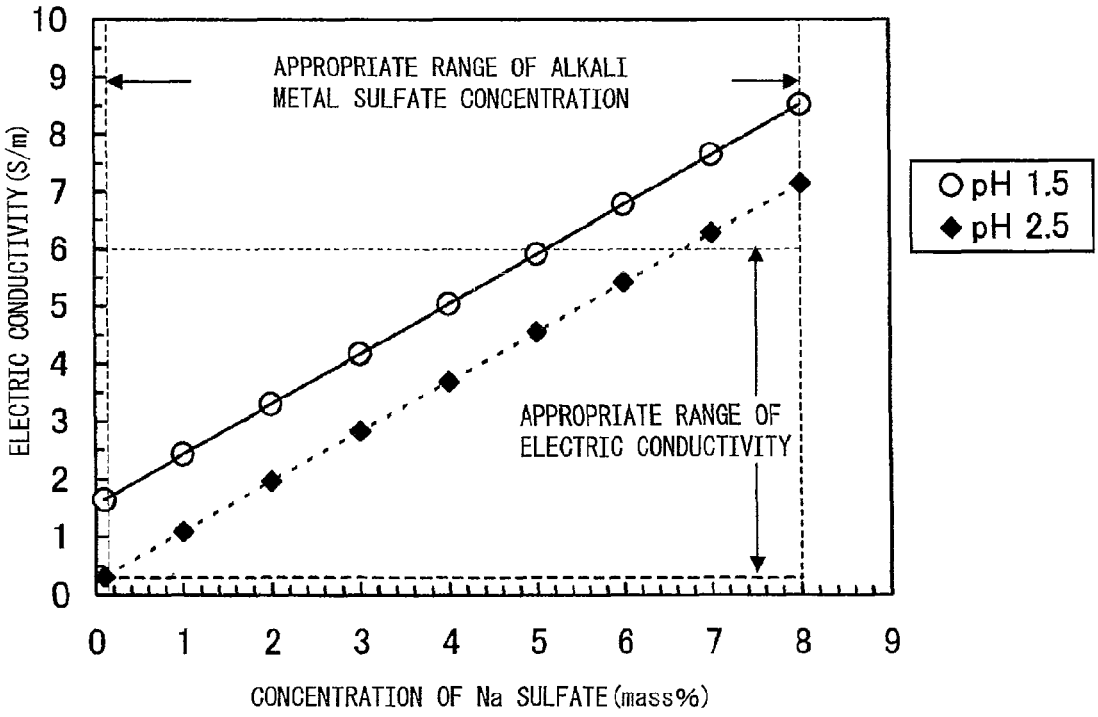
FIG. 11 is a graph showing a relationship between the sodium sulfate concentration (mass %) and the electric conductivity of a solution, wherein zirconium sulfate has been added to an aqueous sodium sulfate solution so as to provide a zirconium concentration of 10 mg/L, and sulfuric acid is added thereto so that pH of the solution has been adjusted to 1.5 or 2.5.

FIG. 11 is a graph showing a relationship between the sodium sulfate concentration (mass %) and the electric conductivity of an aqueous solutions of sodium sulfate containing a zirconium compound (the zirconium concentration: 10 mg/L). In this case, the pH of the solution has been regulated to 1.5 and 2.5 by adding sulfuric acid.

Figure 12:
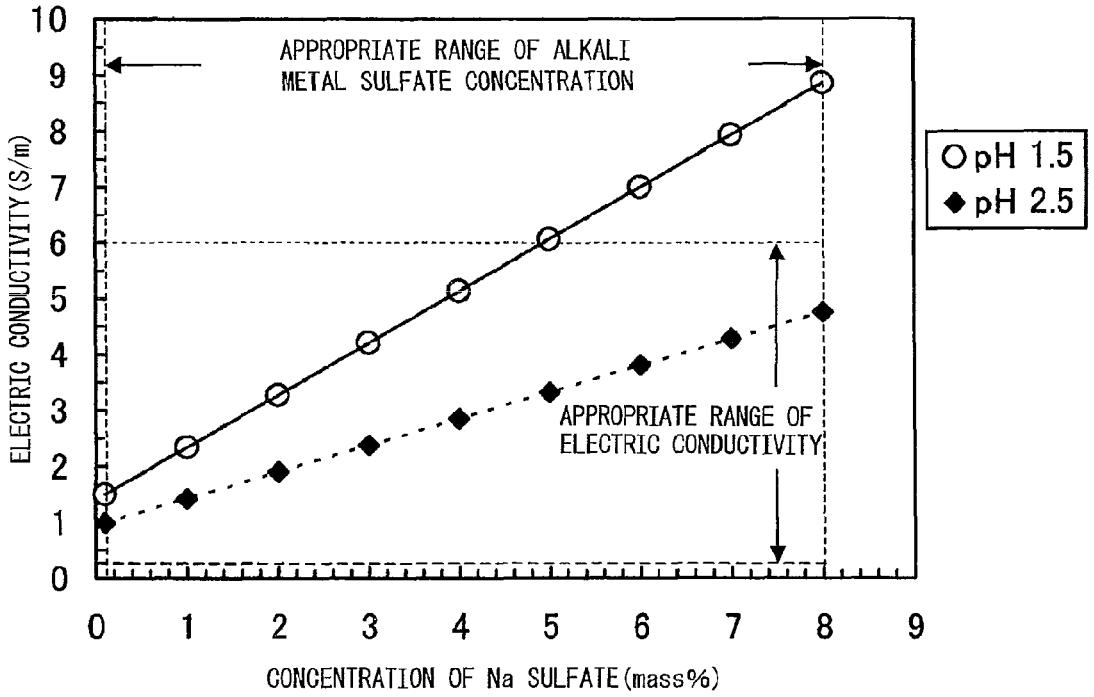
FIG. 12 is a graph showing a relationship between a sodium sulfate concentration (mass %), and the electric conductivity of a treatment solution, wherein zirconium sulfate has been added to an aqueous sodium sulfate solution so as to provide a zirconium concentration of 2000 mg/L, and sulfuric acid is added thereto so that pH of the solution has been adjusted to 1.5 or 2.5.

FIG. 12 is a graph showing a relationship between the sodium sulfate concentration (mass %) and the electric conductivity of an aqueous solutions of sodium sulfate containing a zirconium compound (the zirconium concentration: 2000 mg/L). In this case, the pH of the solution has been regulated to 1.5 and 2.5 by adding sulfuric acid.

As can be seen from FIG. 11 and FIG. 12, the electric conductivity of the cathodic electrolytic coating treatment solution according to the present invention may be changed depending on the concentration of the zirconium compound, the concentration of the alkali metal sulfate, and pH. Accordingly, after the determination of the concentration of a zirconium compound, it may be preferred to regulate the pH and the electric conductivity to be in an appropriate range by adding, as appropriate, a suitable amount of the alkali metal sulfate and concentrated sulfuric acid.

With regard to the temperature of a treatment solution during the cathodic electrolytic coating treatment according to the present invention, a range of 5° C. to 50° C. provides a high deposition efficiency of a zirconium compound and a small variation in the concentration due to evaporation, and accordingly this range may be preferred.

When the temperature of the solution becomes high, the rate of supplying hydrogen ions to the cathode interface is increased, and the zirconium compound is less liable to be deposited. Accordingly, in order to obtain an appropriate zirconium coating amount, the current density should be enhanced, and as a result, the load to the rectifier becomes excessive. Accordingly, the temperature of the solution may preferably be 50° C. or less.

Further, if the temperature of the solution is high, the stability of the solution is decreased, and zirconium oxide hydrate is liable to be deposited. For this reason as well, the upper limit of the temperature of the solution may preferably be 50° C. or less.

With regard to the lower limit of the temperature of the solution during the cathodic electrolytic coating treatment, when the concentration of the alkali metal sulfate is high, the alkali metal sulfate may be deposited, if the temperature is below 5° C. Therefore, the lower limit of the temperature of the solution may preferably be 5° C. or more.

In the cathodic electrolytic coating treatment according to the present invention, after the treatment, it is preferred to conduct washing with water or washing with warm water.

When the cathodic electrolytic coating treatment solution according to the present invention is subjected to an electrolytic treatment, sulfate ions ($SO_4^{2-}$) may remain in the zirconium compound-containing coating film, and the excess sulfate ions remaining in the coating film may cause a color change so that a stain on the surface may be caused and the adhesion after coating may be decreased. Accordingly, such residual ions may not be preferred.

After the cathodic electrolytic coating treatment with the cathodic electrolytic coating treatment solution according to the present invention, it is sufficient to conduct washing with water or washing with warm water, in an extent such that the washing operation may not be a heavy burden. The amount of sulfate ions ($SO_4^{2}$) remaining in the zirconium compound-containing coating film may preferably be controlled to be within a range (0.2 mg/m$^2$ or more and 7 mg/m$^2$ or less) which is almost equal to that of the remaining sulfate ions after the chromate treatment.

After the cathodic electrolytic coating treatment, it is preferred to conduct drying so as to evaporate the moisture. The drying operation may conducted by natural drying or hot-air drying. When the coating amount of the zirconium compound is large, much moisture may remain in the coating film. Accordingly, in this case, hot-air drying may be more preferred.

<Laminated Steel Sheet for Container Material>

The steel sheet for a container material according to the present invention as described above may preferably be used for the production of a laminated steel sheet for a container material. The structure of such a laminated steel sheet for a container material using a steel sheet for a container material according to the present invention is not particularly limited. For example, such a laminated steel sheet for a container material may preferably comprise, at least, a steel sheet for a container material as describe hereinabove, and a laminate film disposed thereon.

<Precoated Steel Sheet for Container Material>

The steel sheet for a container material according to the present invention mentioned above may preferably be used for the production of a precoated steel sheet for a container material. The structure of the precoated steel sheet for a container material using a steel sheet for a container material according to the present invention is not particularly limited. For example, such a laminated steel sheet for a container material may preferably comprise, at least, a steel sheet for a container material as describe hereinabove, and an organic resin coating film disposed thereon.

EXAMPLES

In the Examples and Comparative Examples, the respective tests were conducted in the following manner.

1. Measurement of Thickness of Tin Oxide Layer

The thickness of the tin oxide layer as shown in each of the Examples and Comparative Examples appearing hereinafter was measured by calculating the amount of electricity from the electric stripping time, until the removal of the tin oxide layer at the time of constant current electric stripping in a 0.01% HBr aqueous solution at 1 mA by using the tin-plated steel sheet as an anode. The results are expressed as the amount of electricity required for the electric stripping per unit area (mC/cm$^2$).

2. Cathodic Electrolytic Coating Treatment

Into a circulating-type vertical cell (circulating fluid volume: 15 L), the cathodic electrolytic coating treatment solution was placed, and a tin oxide-removed tin-plated steel sheet was subjected to electrolytic coating treatment with the Pt-thermal sprayed Ti sheet as an electrode, and then washed with water and dried in a hot air, to thereby obtain a cathodic electrolytic treatment tin-plated steel sheet.

The quality of the appearance of the resultant coating film was visually evaluated.

3. Measurement of Primer Deposition Amount

The amount of primer deposition after the primer treatment was measured by measuring the amount of zirconium in the zirconium compound coating by use of a fluorescent X-ray absorption spectrum measurement. The results are expressed as an amount per unit area (mg/m$^2$).

4. Evaluation of Storage Stability of Cathodic Electrolytic Coating Treatment Solution One liter of the cathodic electrolytic coating treatment solution which had been was sufficiently stirred after the preparation thereof was placed in a glass beaker, capped with a poly-wrap, stored in an 40° C. incubator for 2 weeks, and then returned to room temperature (20-25° C.). The presence of white turbidity of the cathodic electrolytic coating treatment solution in the beaker, the presence of precipitation therein, or the presence of the deposition of the alkali metal sulfate were visually examined.

5. Preparation of Pre-Coated Steel Sheets

Onto the surface of each of the steel sheets, which had been obtained by performing up to the primer treatment step in the Examples and Comparative Examples, an epoxy coating material to be used for cans (Sizing varnish PG-800-88, mfd. by Dainippon Ink & Chemicals) was applied by using a bar coater to so as to provide 25 g/m$^2$ per one side, then baked in a baking drying oven at 180° C. for 10 minutes.

6. Preparation of T-Peel Test Piece for Evaluation of Coating Adhesion

The coated surfaces of two pre-coated steel sheets were hot-bonded by using a hot press via an ethylene acrylic acid (EAA) adhesive film (0.1 mm thick) (200° C., 60 seconds, 1 MPa). After the hot bonding, the test piece was cooled and was cut into bonded test pieces having a width of 10 mm and a length of 150 mm. About 50 mm of the lengths of the bonded test pieces were peeled off in advance, as clamping margins for the tensile tests, so as to prepare T-peel test pieces.

11. Evaluation of Coating Adhesion (T-Peel Test)

The clamping margins which had been peeled in advance were clamped by the clamps of a tensile tester. The T-peel strength was measured for 100 mm of the bonded part at room temperature at a tensile speed of 20 mm/min so as to evaluate the coating adhesion.

A person skilled in the art has already known from his experience that a T-peel strength of about 60 N/100 mm or more should be required for the forming adhesion after the coating of a tin-plated steel sheet, and accordingly for a zirconium compound-coated tin-plated steel sheet should also satisfy the coating material adhesion (T-peel) of 60 N/10 mm or more.

8. Preparation of Film-Laminated Steel Sheet

The front and back surfaces of each of the steel sheets which dad been prepared in the Examples and Comparative Examples were heated to 7° C. lower than the melting point of tin (that is, 225° C.), then the two surfaces were hot-laminated with 20 μm-thick undrawn copolymer polyester (melting point 220° C.) film at a laminate roll temperature of 150° C. by a threading (or processing) speed of 150 m/min, and immediately water cooled, to thereby obtain a film-laminated steel sheet.

6. Can Making

Two sides of a film laminated steel sheet was coated with a wax-based lubricant, then punched out by a press into a disk of a diameter of 155 mm, to thereby obtain a shallow drawn cup. Next, this shallow drawn cup was stretch ironed to thereby obtain a cup having a cup diameter of 52 mm, a cup height of 138 mm, and a rate of reduction in average sheet thickness can of the side walls of 18%. This cup was heat treated at 215° C. for film stress relief, then was heat treated at 200° C. corresponding to printing and baking to thereby prepare a sample for evaluation of the can properties.

10. Scratching of Can-Making Product and Retorting

The entire periphery at a height of 75 mm from the bottom of a can product was scratched with a cutter knife, and then the can was placed in a steam boiler for retorting, and retort-sterilized at 125° C. for 90 minutes.

The quality of peeling due to contraction of the part of the film which had been scratched by a cutter knife of the retorted can was visually examined (Evaluation C: when peeling was observed; and Evaluation A: peeling was not observed).

Table 1 shows the details of the contents of the steel sheets used in Working Examples and Comparative Examples.

TABLE 1

| Symbol | Thickness of steel sheet | Tin coating amount ($g/m^2$) | Method of removing tin oxide | Amount of residual tin oxide |
|---|---|---|---|---|
| a | 0.18 mm | Front/back = 2.8/2.8 | Cathodic electrolysis in an aqueous $Na_2CO_3$ (30 g/l) solution, then washing with water and drying Electrolysis condition: 5 $A/dm^2$ × 10 seconds (40° C.) | 0.7 ($mC/cm^2$) |
| b | 0.18 mm | Front/back = 2.8/2.8 | Cathodic electrolysis in an aqueous $NaHCO_3$ (30 g/l) solution, then washing with water and drying Electrolysis condition: 5 $A/dm^2$ × 10 seconds (40° C.) | 0.9 ($mC/cm^2$) |
| c | 0.18 mm | Front/back = 2.8/2.8 | Immersion in an aqueous $H_2SO_4$ (2%) solution, then washing with water and drying Immersing condition: Solution temperature 40° C. × 15 seconds | 1.0 ($mC/cm^2$) |
| d | 0.18 mm | Front/back = 2.8/2.8 | Immersion in an aqueous $H_2SO_4$ (1%) solution, then washing with water and drying Immersing condition: Solution temperature 40° C. × 5 seconds | 3.5 ($mC/cm^2$) |
| e | 0.18 mm | Front/back = 2.8/2.8 | Immersion in an aqueous $H_2SO_4$ (1%) solution, then washing with water and drying Immersing condition: Solution temperature 40° C. × 1 second | 3.8 ($mC/cm^2$) |
| f | 0.18 mm | Front/back = 2.8/2.8 | No treatment | 4.4 ($mC/cm^2$) |

The steel sheet "a" in Table 1 is a steel sheet which has been obtained by the tin oxide removal treatment of a tin-plated steel sheet by cathodic electrolytic treatment in an aqueous sodium carbonate solution at 40° C. and a steel sheet wherein the residual amount of tin oxide measured by the electrolytic stripping method is 0.7 ($mC/cm^2$).

The steel sheet "b" in Table 1 is a steel sheet which has been obtained by the tin oxide removal treatment of a tin-plated steel sheet by cathodic electrolytic treatment in an aqueous sodium hydrogen carbonate solution at 40° C. and a steel sheet wherein the residual amount of tin oxide measured by the electrolytic stripping method is 0.9 ($mC/cm^2$).

The steel sheet "c" in Table 1 is a steel sheet which has been obtained by the tin oxide removal treatment by immersing a tin-plated steel sheet in 2% sulfuric acid for 10 seconds at 40° C. and a steel sheet wherein the residual amount of tin oxide measured by the electrolytic stripping method is 1.0 ($mC/cm^2$).

The steel sheet "d" in Table 1 is a steel sheet which has been obtained by the tin oxide removal treatment by immersing a tin-plated steel sheet in 1% sulfuric acid for 5 seconds at 40° C. and a steel sheet wherein the residual amount of tin oxide measured by the electrolytic stripping method is 3.5 ($mC/cm^2$).

The steel sheet "e" in Table 1 is a steel sheet which has been obtained by the tin oxide removal treatment by immersing a tin-plated steel sheet in 1% sulfuric acid for 1 second at 40° C. and a steel sheet wherein the residual amount of tin oxide measured by the electrolytic stripping method is 3.8 ($mC/cm^2$).

The steel sheet "f" in Table 1 is a steel sheet which has not been subjected to the tin oxide removal treatment and a steel sheet wherein the residual amount of tin oxide measured by the electrolytic stripping method is 4.4 ($mC/cm^2$).

Table 2 shows the steel sheets of Examples and the steel sheets of Table 1 as Comparative Examples, the type and concentration of alkali metal sulfate, zirconium concentration, electric conductivity and pH of the cathodic electrolytic coating treatment solution based on the zirconium compound-added alkali metal sulfate.

TABLE 2

| | Steel sheet | Alkali metal sulfate | Zr concentration (mg/L) | Electric conductivity (S/m) | pH |
|---|---|---|---|---|---|
| Ex. 1 | a | Sulfuric acid a (2.4 mass %) | 400 | 1.2 | 1.9 |
| Comp. Ex. 1 | a | None | 400 | 0.4 | 1.9 |
| Ex. 2 | a | Sulfuric acid Na (1.3 mass %) | 10 | 2.0 | 1.9 |
| Comp. Ex. 2 | a | Sulfuric acid Na (1.2 mass %) | 8 | 2.0 | 1.9 |
| Ex. 3 | a | Sulfuric acid Na (1.0 mass %) | 2000 | 2.0 | 1.9 |

TABLE 2-continued

| | Steel sheet | Alkali metal sulfate | Zr concentration (mg/L) | Electric conductivity (S/m) | pH |
|---|---|---|---|---|---|
| Comp. Ex. 3 | a | Sulfuric acid Na (1.0 mass %) | 2050 | 2.0 | 1.9 |
| Ex. 4 | a | Sulfuric acid Na (0.1 mass %) | 10 | 0.20 | 2.5 |
| Comp. Ex. 4 | a | Sulfuric acid Na (0.09 mass %) | 10 | 0.18 | 2.5 |
| Ex. 5 | a | Sulfuric acid Na (5.9 mass %) | 400 | 6.0 | 1.9 |
| Comp. Ex. 5 | a | Sulfuric acid Na (6.0 mass %) | 400 | 6.2 | 1.9 |
| Comp. Ex. 6 | a | Sulfuric acid Na (6.2 mass %) | 400 | 6.6 | 1.9 |
| Ex. 6 | a | Sulfuric acid Na (0.9 mass %) | 400 | 2.0 | 1.5 |
| Comp. Ex. 7 | a | Sulfuric acid Na (0.9 mass %) | 400 | 2.0 | 1.4 |
| Ex. 7 | a | Sulfuric acid Na (1.6 mass %) | 400 | 2.0 | 2.5 |
| Comp. Ex. 8 | a | Sulfuric acid Na (1.6 mass %) | 400 | 2.0 | 2.6 |
| Ex. 8 | a | Sulfuric acid K (2.1 mass %) | 400 | 1.2 | 1.9 |
| Ex. 9 | a | Sulfuric acid K (1.1 mass %) | 10 | 2.0 | 1.9 |
| Comp. Ex. 9 | a | Sulfuric acid K (1.0 mass %) | 8 | 2.0 | 1.9 |
| Ex. 10 | a | Sulfuric acid K (0.9 mass %) | 2000 | 2.0 | 1.9 |
| Comp. Ex. 10 | a | Sulfuric acid K (0.9 mass %) | 2050 | 2.0 | 1.9 |
| Ex. 11 | a | Sulfuric acid K (0.1 mass %) | 10 | 0.20 | 2.5 |
| Comp. Ex. 11 | a | Sulfuric acid K (0.09 mass %) | 10 | 0.18 | 2.5 |
| Ex. 12 | a | Sulfuric acid K (5.0 mass %) | 400 | 6.0 | 1.9 |
| Comp. Ex. 12 | a | Sulfuric acid K (5.1 mass %) | 400 | 6.2 | 1.9 |
| Comp. Ex. 13 | a | Sulfuric acid K (5.3 mass %) | 400 | 6.6 | 1.9 |
| Ex. 13 | a | Sulfuric acid K (0.8 mass %) | 400 | 2.0 | 1.5 |
| Comp. Ex. 14 | a | Sulfuric acid K (0.8 mass %) | 400 | 2.0 | 1.4 |
| Ex. 14 | a | Sulfuric acid K (1.4 mass %) | 400 | 2.0 | 2.5 |
| Comp. Ex. 15 | a | Sulfuric acid K (1.4 mass %) | 400 | 2.0 | 2.6 |
| Ex. 15 | a | Sulfuric acid Na (8.0 mass %) | 2000 | 6.0 | 2.2 |
| Comp. Ex. 16 | a | Sulfuric acid Na (8.2 mass %) | 2000 | 6.1 | 2.2 |
| Ex. 16 | b | Sulfuric acid Na (2.4 mass %) | 400 | 1.2 | 1.9 |
| Ex. 17 | c | Sulfuric acid Na (2.4 mass %) | 400 | 1.2 | 1.9 |
| Ex. 18 | d | Sulfuric acid Na (2.4 mass %) | 400 | 1.2 | 1.9 |
| Comp. Ex. 17 | e | Sulfuric acid Na (2.4 mass %) | 400 | 1.2 | 1.9 |
| Comp. Ex. 18 | f | Sulfuric acid Na (2.4 mass %) | 400 | 1.2 | 1.9 |

Example 1 is an example wherein the sheet is "a" in Table 1, and the cathodic electrolytic solution has a sodium sulfate concentration of 2.4 mass %, a zirconium concentration of 400 mg/L, an electric conductivity of 1.2 S/m, and a pH of 1.9.

Example 2 is an example wherein the sheet is "a" in Table 1, and the cathodic electrolytic solution has a sodium sulfate concentration of 1.3 mass %, a zirconium concentration of 10 mg/L, an electric conductivity of 2.0 S/m, and a pH of 1.9.

Example 3 is an example wherein the sheet is "a" in Table 1, and the cathodic electrolytic solution has a sodium sulfate concentration of 1.0 mass %, a zirconium concentration of 2000 mg/L, an electric conductivity of 2.0 S/m, and a pH of 1.9.

Example 4 is an example wherein the sheet is "a" in Table 1, and the cathodic electrolytic solution has a sodium sulfate concentration of 0.1 mass %, a zirconium concentration of 10 mg/L, an electric conductivity of 0.20 S/m, and a pH of 2.5.

Example 5 is an example wherein the sheet is "a" in Table 1, and the cathodic electrolytic solution has a sodium sulfate concentration of 5.9 mass %, a zirconium concentration of 400 mg/L, an electric conductivity of 6.0 S/m, and a pH of 1.9.

Example 6 is an example wherein the sheet is "a" in Table 1, and the cathodic electrolytic solution has a sodium sulfate concentration of 0.9 mass %, a zirconium concentration of 400 mg/L, an electric conductivity of 2.0 S/m, and a pH of 1.5.

Example 7 is an example wherein the sheet is "a" in Table 1, and the cathodic electrolytic solution has a sodium sulfate concentration of 1.6 mass %, a zirconium concentration of 400 mg/L, an electric conductivity of 2.0 S/m, and a pH of 2.5.

Example 8 is an example wherein the sheet is "a" in Table 1, and the cathodic electrolytic solution has a potassium sulfate concentration of 2.1 mass %, a zirconium concentration of 400 mg/L, an electric conductivity of 1.2 S/m, and a pH of 1.9.

Example 9 is an example wherein the sheet is "a" in Table 1, and the cathodic electrolytic solution has a potassium sulfate concentration of 1.1 mass %, a zirconium concentration of 10 mg/L, an electric conductivity of 2.0 S/m, and a pH of 1.9.

Example 10 is an example wherein the sheet is "a" in Table 1, and the cathodic electrolytic solution has a potassium sulfate concentration of 0.9 mass %, a zirconium concentration of 2000 mg/L, an electric conductivity of 2.0 S/m, and a pH of 1.9.

Example 11 is an example wherein the sheet is "a" in Table 1, and the cathodic electrolytic solution has a potassium sulfate concentration of 0.1 mass %, a zirconium concentration of 10 mg/L, an electric conductivity of 0.2 S/m, and a pH of 2.5.

Example 12 is an example wherein the sheet is "a" in Table 1, and the cathodic electrolytic solution has a potassium sulfate concentration of 5.0 mass %, a zirconium concentration of 400 mg/L, an electric conductivity of 6.0 S/m, and a pH of 1.9.

Example 13 is an example wherein the sheet is "a" in Table 1, and the cathodic electrolytic solution has a potassium sulfate concentration of 0.8 mass %, a zirconium concentration of 400 mg/L, an electric conductivity of 2.0 S/m, and a pH of 1.5.

Example 14 is an example wherein the sheet is "a" in Table 1, and the cathodic electrolytic solution has a potassium sulfate concentration of 1.4 mass %, a zirconium concentration of 400 mg/L, an electric conductivity of 2.0 S/m, and a pH of 2.5.

Example 15 is an example wherein the sheet is "a" in Table 1, and the cathodic electrolytic solution has a sodium sulfate concentration of 8.0 mass %, a zirconium concentration of 2000 mg/L, an electric conductivity of 6.0 S/m, and a pH of 2.2.

Example 16 is an example wherein the sheet is "b" in Table 1, and the cathodic electrolytic solution has a sodium sulfate concentration of 2.4 mass %, a zirconium concentration of 400 mg/L, an electric conductivity of 1.2 S/m, and a pH of 1.9.

Example 17 is an example wherein the sheet is "c" in Table 1, and the cathodic electrolytic solution has a sodium sulfate concentration of 2.4 mass %, a zirconium concentration of 400 mg/L, an electric conductivity of 1.2 S/m, and a pH of 1.9.

Example 18 is an example wherein the sheet is "d" in Table 1, and the cathodic electrolytic solution has a sodium sulfate concentration of 2.4 mass %, a zirconium concentration of 400 mg/L, an electric conductivity of 1.2 S/m, and a pH of 1.9.

Comparative Example 1 is an example wherein the sheet is "a" in Table 1, and the cathodic electrolytic solution has a zirconium concentration of 400 mg/L containing no alkali metal sulfate, an electric conductivity of 0.4 S/m, and a pH of 1.9.

Comparative Example 2 is an example wherein the sheet is "a" in Table 1, and the cathodic electrolytic solution has a sodium sulfate concentration of 1.2 mass %, a zirconium concentration of 8 mg/L, an electric conductivity of 2.0 S/m, and a pH of 1.9.

Comparative Example 3 is an example wherein the sheet is "a" in Table 1, and the cathodic electrolytic solution has a sodium sulfate concentration of 1.0 mass %, a zirconium concentration of 2050 mg/L, an electric conductivity of 2.0 S/m, and a pH of 1.9.

Comparative Example 4 is an example wherein the sheet is "a" in Table 1, and the cathodic electrolytic solution has a sodium sulfate concentration of 0.09 mass %, a zirconium concentration of 10 mg/L, an electric conductivity of 0.18 S/m, and a pH of 2.5.

Comparative Example 5 is an example wherein the sheet is "a" in Table 1, and the cathodic electrolytic solution has a sodium sulfate concentration of 6.0 mass %, a zirconium concentration of 400 mg/L, an electric conductivity of 6.2 S/m, and a pH of 1.9.

Comparative Example 6 is an example wherein the sheet is "a" in Table 1, and the cathodic electrolytic solution has a sodium sulfate concentration of 6.2 mass %, a zirconium concentration of 400 mg/L, an electric conductivity of 6.6 S/m, and a pH of 1.9.

Comparative Example 7 is an example wherein the sheet is "a" in Table 1, and the cathodic electrolytic solution has a sodium sulfate concentration of 0.9 mass %, a zirconium concentration of 400 mg/L, an electric conductivity of 2.0 S/m, and a pH of 1.4.

Comparative Example 8 is an example wherein the sheet is "a" in Table 1, and the cathodic electrolytic solution has a sodium sulfate concentration of 1.6 mass %, a zirconium concentration of 400 mg/L, an electric conductivity of 2.0 S/m, and a pH of 2.6.

Comparative Example 9 is an example wherein the sheet is "a" in Table 1, and the cathodic electrolytic solution has a potassium sulfate concentration of 1.0 mass %, a zirconium concentration of 8 mg/L, an electric conductivity of 2.0 S/m, and a pH of 1.9.

Comparative Example 10 is an example wherein the sheet is "a" in Table 1, and the cathodic electrolytic solution has a potassium sulfate concentration of 0.9 mass %, a zirconium concentration of 2050 mg/L, an electric conductivity of 2.0 S/m, and a pH of 1.9.

Comparative Example 11 is an example wherein the sheet is "a" in Table 1, and the cathodic electrolytic solution has a potassium sulfate concentration of 0.09 mass %, a zirconium concentration of 10 mg/L, an electric conductivity of 0.18 S/m, and a pH of 2.5.

Comparative Example 12 is an example wherein the sheet is "a" in Table 1, and the cathodic electrolytic solution has a potassium sulfate concentration of 5.1 mass %, a zirconium concentration of 400 mg/L, an electric conductivity of 6.2 S/m, and a pH of 1.9.

Comparative Example 13 is an example wherein the sheet is "a" in Table 1, and the cathodic electrolytic solution has a potassium sulfate concentration of 5.3 mass %, a zirconium concentration of 400 mg/L, an electric conductivity of 6.6 S/m, and a pH of 1.9.

Comparative Example 14 is an example wherein the sheet is "a" in Table 1, and the cathodic electrolytic solution has a potassium sulfate concentration of 0.8 mass %, a zirconium concentration of 400 mg/L, an electric conductivity of 2.0 S/m, and a pH of 1.4.

Comparative Example 15 is an example wherein the sheet is "a" in Table 1, and the cathodic electrolytic solution has a potassium sulfate concentration of 1.4 mass %, a zirconium concentration of 400 mg/L, an electric conductivity of 2.0 S/m, and a pH of 2.6.

Comparative Example 16 is an example wherein the sheet is "a" in Table 1, and the cathodic electrolytic solution has a sodium sulfate concentration of 8.2 mass %, a zirconium concentration of 2000 mg/L, an electric conductivity of 6.1 S/m, and a pH of 2.2.

Comparative Example 17 is an example wherein the sheet is "e" in Table 1, and the cathodic electrolytic solution has a sodium sulfate concentration of 2.4 mass %, a zirconium concentration of 400 mg/L, an electric conductivity of 1.2 S/m, and a pH of 1.9.

Comparative Example 18 is an example wherein the sheet is "f" in Table 1, and the cathodic electrolytic solution has a sodium sulfate concentration of 2.4 mass %, a zirconium concentration of 400 mg/L, an electric conductivity of 1.2 S/m, and a pH of 1.9.

Table 3 shows the results of evaluation of the sheets and the solutions during the cathodic electrolytic coating treatment of each of tin-plated steel sheets with a combination of a tin-plated steel sheet and the cathodic electrolytic coating treatment solution in Table 2.

The contents of evaluations are as follows:

1) A film coating amount converted to zirconium of a primer coating film, when a tin-plated steel sheet was subjected to cathodic electrolytic treatment at 4 A/dm$^2$ and 6 A/dm$^2$ for 1 second.

2) Quality of the appearance of a zirconium compound-containing coating film

Evaluations:

"A" and passed: when no unevenness is observed in the appearance of the zirconium compound-containing coating film;

"B" and not passed: when uneven shades are observed;

"C" and not passed: when clear uneven shades are observed.

3) Coating adhesion of a steel sheet, when a tin-plated steel sheet was subjected to cathodic electrolytic treatment at 4 A/dm$^2$ for 1 second with a combination of a tin-plated steel sheet and the cathodic electrolytic coating treatment solution in Table 2. In this case, T-peel strength of the coated sheet was evaluated, and "60 or more" was judged to be passed.

4) Resistance to retort peeling of a canned product was evaluated to examine the film adhesion of a laminated steel sheet by using a steel sheet which has been obtained by the cathodic electrolytic treatment of a tin-plated steel sheet at 4 A/dm$^2$ for 1 second with a combination of a tin-plated steel sheet and the cathodic electrolytic coating treatment solution in Table 2.

Evaluations:

"C" and not passed: when cutter knife scratches which had been made on the periphery of the can provided peeling by retorting;

"A" and passed: when cutter knife scratches which had been made on the periphery of the can did not provide peeling by retorting.

5) Results of visual evaluation of the storage stability of the solution.

Evaluations:

"A" and passed: when the results were good;

B and passed: when slightly white turbidity was observed but no precipitation was observed;

C and not passed: when white precipitates were observed.

6) Dissolution stability of an alkali metal sulfate in low temperature solution

The dissolution stability was evaluated in terms of the presence or absence of deposition, when the solution was cooled to 5° C.

Evaluations:

"A" and passed: when the dissolved alkali metal sulfate was not deposited;

"C" and not passed: when the dissolved alkali metal sulfate was deposited.

7) Degree of load on the rectifier

The Degree of load was evaluated in terms of the voltage of the rectifier after electrolytic treatment at a current density of 4 A/dm$^2$ and 6 A/dm$^2$.

Evaluations:

"A" and passed: when the voltage of the rectifier was less than 20 V;

"8": when the voltage of the rectifier was 20 V or more and 25 V or less;

"C" and not passed: when the voltage of the rectifier exceeded 25 V.

As can be seen from Example 1, Example 8 and Comparative Example 1 in Table 3, when an alkali metal sulfate is not contained as in the case of Comparative Example 1, even if the zirconium concentration and the pH are the same, the storage stability of the solution is poor. Accordingly, the presence of an alkali metal sulfate such as sodium sulfate and potassium sulfate, in addition to zirconium sulfate provides the better storage stability of the solution, and accordingly this may be preferred.

As can be seen from Example 2, Comparative Example 2, Example 9 and Comparative Example 9 in Table 3, in the case of Examples 2 and 9 wherein the zirconium concentration is 10 mg/L, a film coating amount converted to zirconium of 0.1 mg/m$^2$ or more which is required to obtain a good coating material adhesion. On the other hand, in the case of Comparative Examples 2 and 9 wherein the zirconium concentration is less than 10 mg/L, the film coating amount converted to zirconium becomes less than 0.1 mg/m$^2$ so that it difficult to obtain sufficient coating material adhesion and film adhesion, and accordingly this may not be preferred.

As can be seen from Example 3, Comparative Example 3, Example 10 and Comparative Example 10 in Table 3, in the case of Examples 3 and 10 wherein the zirconium concentration is 2000 mg/L, the film coating amount converted to zirconium is 20 mg/m$^2$ or less which is required to obtain a good coating material adhesion. On the other hand, in the case of Comparative Examples 3 and 10 wherein the zirconium concentration exceeds 2000 mg/L, the film coating amount

TABLE 3

| | Coating amount converted to zirconium (mg/m$^2$) | | Quality of | T-peel strength | Anti-retorting | | Dissolution stability of | Rectifier load | |
|---|---|---|---|---|---|---|---|---|---|
| Primer treatment | Current density 4 A/dm$^2$ | Current density 6 A/dm$^2$ | coating film appearance | of coated sheet (N/10 mm) | peeling of laminate can film | Storage stability of solution | alkali metal sulfate (at 5° C.) | Current density 4 A/dm$^2$ | Current density 6 A/dm$^2$ |
| Ex. 1 | 3.7 | 4.2 | A | 72 | A | A | A | A | A |
| Comp. Ex. 1 | 2.7 | 4.9 | A | 61 | A | C | A | A | A |
| Ex. 2 | 0.15 | 0.18 | A | 68 | A | A | A | A | A |
| Comp. Ex. 2 | 0.05 | 0.08 | A | 45 | C | A | A | A | A |
| Ex. 3 | 17.0 | 19.0 | A | 65 | A | A | A | A | A |
| Comp. Ex. 3 | 21.0 | 25.0 | C | 42 | C | B | A | A | A |
| Ex. 4 | 1.8 | 2.2 | A | 77 | A | A | A | A | B |
| Comp. Ex. 4 | 1.6 | 2.0 | A | 71 | A | A | A | B | C |
| Ex. 5 | 3.5 | 1.8 | A | 67 | A | A | A | A | A |
| Comp. Ex. 5 | 4.2 | 1.2 | B | 62 | A | A | A | A | A |
| Comp. Ex. 6 | 3.7 | 0.5 | C | 60 | A | A | A | A | A |
| Ex. 6 | 0.14 | 0.18 | A | 79 | A | A | A | A | A |
| Comp. Ex. 7 | 0.04 | 0.05 | A | 35 | C | A | A | A | A |
| Ex. 7 | 5.6 | 6.4 | A | 80 | A | A | A | A | A |
| Comp. Ex. 8 | 6.5 | 8.2 | A | 72 | A | C | A | A | A |
| Ex. 8 | 3.2 | 3.5 | A | 74 | A | A | A | A | A |
| Ex. 9 | 0.10 | 0.12 | A | 68 | A | A | A | A | A |
| Comp. Ex. 9 | 0.05 | 0.06 | A | 41 | C | A | A | A | A |
| Ex. 10 | 15.0 | 17.0 | A | 63 | A | A | A | A | A |
| Comp. Ex. 10 | 19.0 | 22.0 | B | 52 | C | B | A | A | A |
| Ex. 11 | 0.80 | 1.0 | A | 63 | A | A | A | A | B |
| Comp. Ex. 11 | 0.50 | 0.80 | A | 61 | A | A | A | B | C |
| Ex. 12 | 3.8 | 2.3 | A | 78 | A | A | A | A | A |
| Comp. Ex. 12 | 3.0 | 0.80 | B | 60 | A | A | A | A | A |
| Comp. Ex. 13 | 2.2 | 0.3 | C | 60 | A | A | A | A | A |
| Ex. 13 | 0.12 | 0.13 | A | 65 | A | A | A | A | A |
| Comp. Ex. 14 | 0.05 | 0.05 | A | 43 | C | A | A | A | A |
| Ex. 14 | 4.5 | 5.5 | A | 80 | A | A | A | A | A |
| Comp. Ex. 15 | 5.8 | 6.2 | A | 77 | A | C | A | A | A |
| Ex. 15 | 9.0 | 10.5 | A | 65 | A | A | A | A | A |
| Comp. Ex. 16 | 11.8 | 8.2 | A | 61 | A | A | C | A | A |
| EX. 16 | 3.6 | 3.9 | A | 79 | A | A | A | A | A |
| EX. 17 | 3.8 | 3.7 | A | 76 | A | A | A | A | A |
| Ex. 18 | 2.5 | 3.0 | A | 70 | A | A | A | A | A |
| Comp. Ex. 17 | 2.7 | 3.5 | A | 48 | C | A | A | A | A |
| Comp. Ex. 18 | 2.5 | 2.8 | A | 41 | C | A | A | A | A |

converted to zirconium may sometimes exceed 20 mg/m$^2$, so that it is difficult to obtain sufficient coating material adhesion and film adhesion, and further uneven shades in the appearance may be produced, and accordingly this may not be preferred.

As can be seen from Example 4, Comparative Example 4, Example 11 and Comparative Example 11 in Table 3, in the case of Examples 4 and 11 wherein the electric conductivity is 0.2 S/m or more and the concentration of the alkali metal sulfate is 0.1 mass %, as compared to Comparative Examples 4 and 11 wherein the electric conductivity is less than 0.2 S/m and the concentration of the alkali metal sulfate is less than 0.1 mass %, the rectifier load is small and accordingly this may be preferred.

As can be seen from Example 5, Comparative Example 5, Comparative Example 6, Example 12, Comparative Example 12 and Comparative Example 13 in Table 3, in the case of Comparative Examples 5, 6, 12 and 13 wherein the electric conductivity exceeds 6.0 S/m, as compared to Examples 5 and 12 wherein the electric conductivity is 6.0 S/m or less, uneven shades tend to be formed in the appearance, and accordingly this may not be preferred.

As can be seen from Example 6, Comparative Example 7, Example 13 and Comparative Example 14 in Table 3, in the case of Examples 6 and 13 wherein the pH is 1.5 or more, a film coating amount converted to zirconium of 0.1 mg/m$^2$ or more, which is required to obtain good coating material adhesion can be obtained. On the other hand, in the case of Comparative Examples 7 and 14 wherein the pH is less than 1.5, the film coating amount converted to zirconium does not reach 0.1 mg/m$^2$ which is required to obtain good coating material adhesion, whereby it difficult to obtain a sufficient coating material adhesion and film adhesion, and accordingly this may not be preferred.

As can be seen from Example 7, Comparative Example 8, Example 14 and Comparative Example 15 in Table 3, in the case of Examples 7 and 14 wherein the pH is 2.5 or less, the storage stability of the solution is good. On the other hand, in the case of Comparative Example 8 and 15 wherein the pH exceeds 2.5, white precipitates are formed during the storage, and accordingly this may not be preferred.

As can be seen from Example 15 and Comparative Example 16 in Table 3, in the case of Example 15 wherein the concentration of the alkali metal sulfate (sodium sulfate) is 8.0 mass % or less, the dissolution stability of the alkali metal sulfate at 5° C. is good. On the other hand, in the case of Comparative Example 16 wherein the concentration of the alkali metal sulfate (sodium sulfate) exceeds 8.0 mass %, the dissolution stability of the alkali metal sulfate at 5° C. is poor, and accordingly this may not be preferred.

As can be seen from Example 16, Example 17, and Example 18 in Table 3, when the thickness of the tin oxide layer disposed on a tin-plated steel sheet is in the range of 0 mC/cm$^2$ to 3.5 mC/cm$^2$ as measured by the electrolytic stripping method, it is found that the coating material adhesion is stable at a T-peel strength of 60 N/10 m or more.

In contrast, as can be seen from Comparative Example 17 and Comparative Example 18, when the amount of tin oxide exceeds 3.5 mC/cm$^2$, it is found that the coating material adhesion may become poor.

Example 19

In a condition similar to that of the graph showing the current density-coating amount in "FIG. 2" mentioned above, Zr coating amount was measure while changing the Zr concentration. The thus obtained results are shown in FIG. 13 and the Table 4 below.

Figure 13:
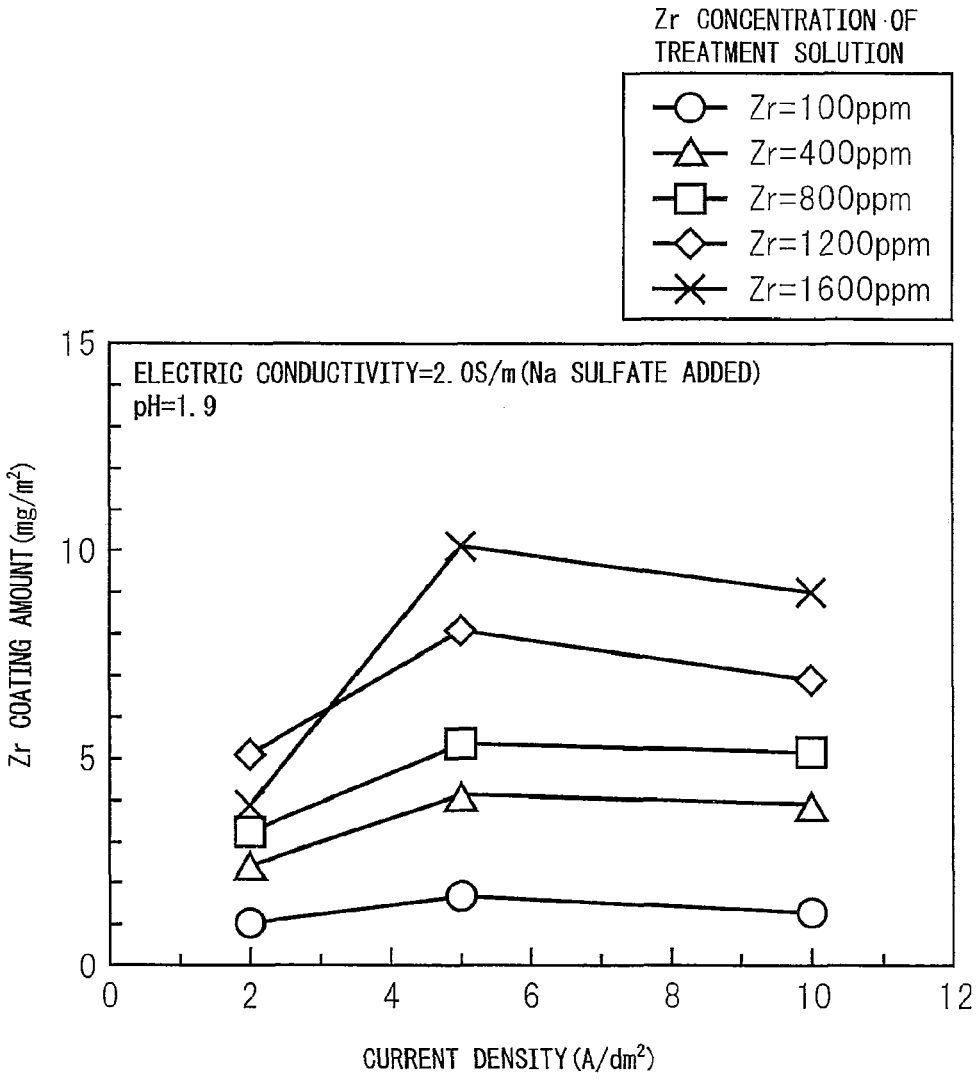
FIG. 13 is a graph showing a relationship between the current density during electrolytic treatment, and the film coating amount converted to zirconium of a primer coating film in the case of a conventional zirconium sulfate treatment solution, and in the case of a sodium sulfate treatment solution containing a zirconium compound according to the present invention. The graph shows that the zirconium deposition amount is stable, even if the zirconium concentration is changed.

From the graph in FIG. 13, it can be understood that the Zr coating amount can be increased by increasing the Zr concentration. Further, from this graph, it can be understood that, in the system according to the present invention, even at a high current density, an abrupt increase in the Zr coating amount can be suppressed (in other words, it is characteristic of the system according to the present invention that the Zr coating amount is stable, even if the Zr concentration is changed).

TABLE 4

Relationship between current density (Dk) and Zr coating amount in Coulomb quantity = 1 C

| Current density (A/dm2) | Zr = 100 ppm | Zr = 400 ppm | Zr = 800 ppm | Zr = 1200 ppm | Zr = 1600 ppm |
|---|---|---|---|---|---|
| 2 | 1.02 | 2.42 | 3.21 | 5.08 | 3.87 |
| 5 | 1.72 | 4.10 | 5.33 | 8.07 | 10.11 |
| 10 | 1.29 | 3.85 | 5.14 | 6.89 | 9.02 |

INDUSTRIAL APPLICABILITY

The environmentally friendly steel sheet for a container material according to the present invention and a process for producing the same does not use a treating solution containing chromium, fluorine and nitrate nitrogen at primer treatment of the steel sheet, and accordingly the steel sheet for a container material according to the present invention is excellent in terms of sanity and safety. In addition, the steel sheet for a container material according to the present invention has a coating material adhesion and a film adhesion, which are comparable to those of the conventional chromated steel sheet for a container material, and also has an excellent formability. Accordingly, the steel sheet according to the present invention is suitable for beverage cans and food cans of the 2-piece structure wherein the formability thereof is severe, and is very useful as a material for a metal container.

The invention claimed is:

1. A process for producing an environmentally friendly steel sheet for a container material, comprising:

removing a tin oxide layer present on a tin-plated steel sheet by a cathodic electrolytic treatment in an aqueous solution containing sodium carbonate or sodium hydrogen carbonate, or by an immersion treatment in an aqueous sulfuric acid solution, so as to provide a thickness of from 0 mC/cm$^2$ to 3.5 mC/cm$^2$ as measured by an electrolytic stripping method, and;

subsequently, forming a coating film by subjecting the tin-plated steel sheet to a cathodic electrolytic coating treatment in an aqueous solution of an alkali metal sulfate not containing a chromium compound, fluorine, or a nitrate nitrogen, but containing a zirconium compound, wherein said aqueous solution of an alkali metal sulfate has an electric conductivity of from 0.2 S/m to 6.0 S/m and a pH of from 1.5 to 2.5, and wherein the coating film has a film coating amount converted to zirconium of from 0.1 mg/m$^2$ to 20 mg/m$^2$.

2. The process for producing an environmentally friendly steel sheet for a container material according to claim 1, wherein a concentration of zirconium in the aqueous solution of the alkali metal sulfate coining a zirconium compound is from 10 mg/L to 2000 mg/L.

3. The process for producing an environmentally friendly steel sheet for a container material according to claim 2, wherein the alkali metal sulfate is sodium sulfate.

4. The process for producing an environmentally friendly steel sheet for a container material according to claim 2, wherein the alkali metal sulfate is potassium sulfate.

5. The process for producing an environmentally friendly steel sheet for a container material according to claim 2, wherein the concentration of the alkali metal sulfate contained in the aqueous solution of the alkali metal sulfate is from 0.1 mass % to 8.0 mass %.

6. The process for producing an environmentally friendly steel sheet for a container material according to claim 1, wherein the alkali metal sulfate is sodium sulfate.

7. The process for producing an environmentally friendly steel sheet for a container material according to claim 1, wherein the alkali metal sulfate is potassium sulfate.

8. The process for producing an environmentally friendly steel sheet for a container material according to claim 1, wherein the concentration of the alkali metal sulfate contained in the aqueous solution of the alkali metal sulfate is from 0.1 mass % to 8.0 mass %.

* * * * *